US010111485B2

(12) United States Patent
Nagely et al.

(10) Patent No.: US 10,111,485 B2
(45) Date of Patent: Oct. 30, 2018

(54) DEVICE FOR REDUCING HEAD AND NECK INJURY FOR HELMET WEARER

(71) Applicant: Scott W. Nagely, Denver, CO (US)

(72) Inventors: Scott W. Nagely, Denver, CO (US); Ian D. Kovacevich, Carlsbad, CA (US)

(73) Assignee: Scott W. Nagely, Denver, CO (US)

( * ) Notice: Subject to any disclaimer, the term of this patent is extended or adjusted under 35 U.S.C. 154(b) by 374 days.

(21) Appl. No.: 15/007,001

(22) Filed: Jan. 26, 2016

(65) Prior Publication Data

US 2016/0213086 A1 Jul. 28, 2016

Related U.S. Application Data

(60) Provisional application No. 62/107,867, filed on Jan. 26, 2015.

(51) Int. Cl.
*A42B 3/04* (2006.01)
*A41D 13/05* (2006.01)

(52) U.S. Cl.
CPC ..... *A42B 3/0473* (2013.01); *A41D 13/0512* (2013.01); *A41D 13/0531* (2013.01); *A41D 2400/70* (2013.01)

(58) Field of Classification Search
CPC ..... A41D 13/015; A41D 13/05212; A42B 3/0473; A63B 71/1291
USPC ..... 2/468, 459, 461; 602/5, 18, 19
See application file for complete search history.

(56) References Cited

U.S. PATENT DOCUMENTS 3,776,224 A 12/1973 McFarland
5,517,699 A 5/1996 Abraham, II
5,930,843 A * 8/1999 Kelly ..... A41D 13/0512 2/421
6,296,393 B1 * 10/2001 Yabe ..... F16C 19/06 384/463
7,426,773 B2 9/2008 Downing et al.
(Continued)

FOREIGN PATENT DOCUMENTS

DE 202005004385 5/2005
DE 202015000232 2/2015
(Continued)

OTHER PUBLICATIONS

"Leatt Dirt Bike Neck Braces and Support", http://www.motosport.com/dirtbike/leatt-neck-braces-and-support, (Accessed Apr. 11, 2016).
(Continued)

*Primary Examiner* — Katherine Moran
(74) *Attorney, Agent, or Firm* — Hovey Williams LLP

(57) ABSTRACT

A motion restrictor device is operable to be worn with a protective helmet to reduce the risk of head or spine injury caused by injurious movement of the helmet. The device includes a helmet-engaging component supported on a harness. The component presents helmet-engagement surfaces positioned on opposite sides of the neck of the user. The component is operable to yieldably bias each of the helmet-engagement surfaces toward the helmet when the device is worn, such that contact with the helmet is maintained as the helmet-engagement surface shifts through a range of motion. The device also includes a brake assembly that restricts shifting of at least one of the helmet-engagement surfaces in response to injurious movement of the helmet.

45 Claims, 21 Drawing Sheets

(56) References Cited

U.S. PATENT DOCUMENTS

| | | | | |
|---|---|---|---|---|
| 7,430,767 | B2 | 10/2008 | Nagely | |
| 7,846,117 | B2 | 12/2010 | Leatt et al. | |
| 7,975,321 | B1 | 7/2011 | Behrens | |
| 8,161,577 | B2 | 4/2012 | Tews | |
| 8,162,865 | B2 | 4/2012 | Mazzarolo | |
| 8,162,866 | B2 | 4/2012 | Mazzarolo | |
| 8,281,419 | B2 | 10/2012 | Rietdyk et al. | |
| 8,393,017 | B2 | 3/2013 | Sheren | |
| 8,439,042 | B2 | 5/2013 | Leatt et al. | |
| 8,484,768 | B2 | 7/2013 | Leatt et al. | |
| 8,562,551 | B2 | 10/2013 | Leatt | |
| 8,590,064 | B1 | 11/2013 | Castillo | |
| 8,832,871 | B2 | 9/2014 | Mazzarolo et al. | |
| 8,834,394 | B2 | 9/2014 | Ghajar | |
| 8,918,920 | B2 | 12/2014 | Jourde et al. | |
| 8,938,820 | B2 | 1/2015 | Mazzarolo et al. | |
| 9,185,945 | B2 | 11/2015 | Rietdyk | |
| 2010/0229290 | A1* | 9/2010 | Nelson | A42B 3/0473 2/425 |
| 2010/0251467 | A1 | 10/2010 | Leatt et al. | |
| 2011/0167548 | A1 | 7/2011 | Jourde et al. | |
| 2012/0144568 | A1 | 6/2012 | Nelson | |
| 2013/0205480 | A1 | 8/2013 | Nagely et al. | |
| 2016/0158630 | A1 | 6/2016 | Stiles et al. | |

FOREIGN PATENT DOCUMENTS

| | | |
|---|---|---|
| FR | 2700746 | 7/1994 |
| WO | 2012042308 | 5/2012 |
| WO | 2015136391 | 9/2015 |

OTHER PUBLICATIONS

Office Action from U.S. Appl. No. 15/340,698 (Office Action dated Apr. 14, 2017).

Amended Accelerated Examination Support Document from U.S. Appl. No. 15/340,698 (dated Mar. 8, 2017).

Amended Pre-Examination Search Document from U.S. Appl. No. 15/340,698 (dated Mar. 8, 2017).

* cited by examiner

DEVICE FOR REDUCING HEAD AND NECK INJURY FOR HELMET WEARER

RELATED APPLICATION

This application claims the benefit of U.S. Provisional Application Ser. No. 62/107,867, filed Jan. 26, 2015, entitled DEVICE FOR REDUCING HEAD AND NECK INJURY FOR HELMET WEARER, which is hereby incorporated in its entirety by reference herein.

BACKGROUND

1. Field

The present invention relates generally to a device operable to restrict motion of a protective helmet. More specifically, embodiments of the present invention concern a motion restrictor device that is designed to reduce the risk of injury caused by excessive or overly rapid movement of a helmet.

2. Discussion of Prior Art

Personal protective safety gear has long been used in connection with various types of physical activity to provide cushioning and to protect the user from injurious movement as a result of the activity. For instance, participants in various vehicular sporting activities have long used safety helmets to protect the user's head from injurious contact with an exterior object. Similarly, participants also use protective gear when taking part in physical sports activities that do not involve a vehicle (e.g., snow skiing, ice hockey, or football) but can cause bodily injury to the participant.

Although helmets provide effective protection against some injuries, it is also well known for the helmet wearer to don additional protective gear to limit head and neck injuries. For instance, it is known for an off-road motorcycle operator to wear a collar structure that fits on top of the operator's shoulder and around the operator's neck. This conventional collar is configured to engage the helmet as the neck flexes and limit the amount of flexing movement.

However, this conventional safety gear has various deficiencies. For instance, conventional helmets and collars lack sufficient protection when the operator experiences a head-first collision with an external object. More particularly, conventional safety gear inadequately restricts compression of the operator's neck and spine during a head-first collision. Additionally, to the extent that any prior art safety gear provides some nominal restriction to compression of the operator's neck and spine, such equipment excessively restricts the helmet's free range of movement during normal operation.

SUMMARY

The following brief summary is provided to indicate the nature of the subject matter disclosed herein. While certain aspects of the present invention are described below, the summary is not intended to limit the scope of the present invention.

Embodiments of the present invention provide a motion restrictor that does not suffer from the problems and limitations of prior art safety devices used with helmets.

A first aspect of the present invention concerns a motion restrictor device to be worn with a protective helmet so as to reduce the risk of head or spine injury caused by injurious movement of the helmet. The motion restrictor device broadly includes a harness, a helmet-engaging component, and a brake assembly. The harness is wearable by a user of the helmet. The helmet-engaging component is supported on the harness. The helmet-engaging component presents laterally spaced apart, fore-and-aft extending helmet-engagement surfaces positioned on opposite sides of the neck of the user when the device is worn. Each of the helmet-engagement surfaces is configured to shift along a range of motion while in contact with the helmet as the helmet moves. The helmet-engaging component is operable to yieldably bias each of the helmet-engagement surfaces toward the helmet when the device is worn, such that contact with the helmet is maintained as the helmet-engagement surface shifts through the range of motion. The brake assembly is operable to restrict shifting of at least one of the helmet-engagement surfaces in response to injurious movement of the helmet.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 22:
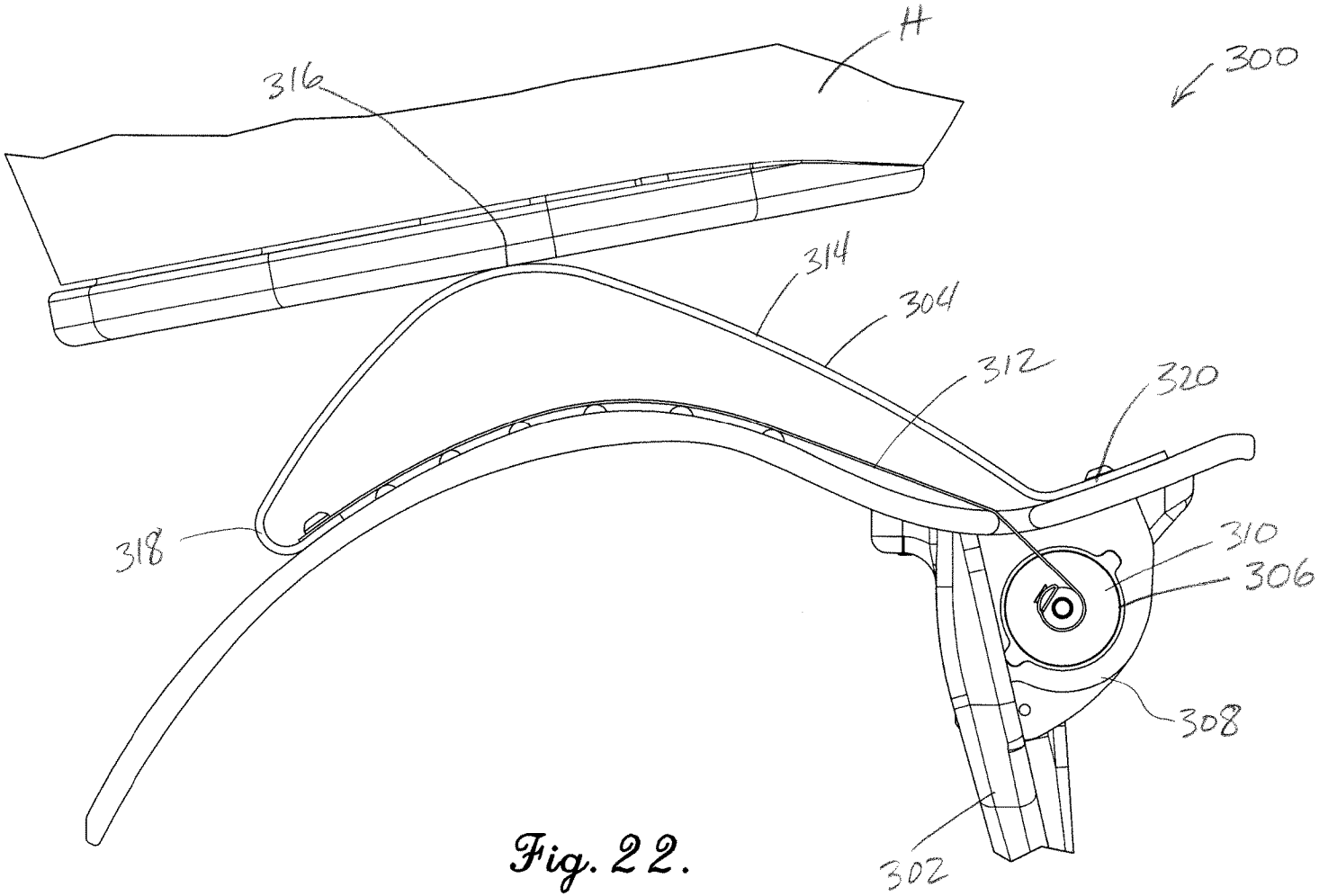
Figure 23:
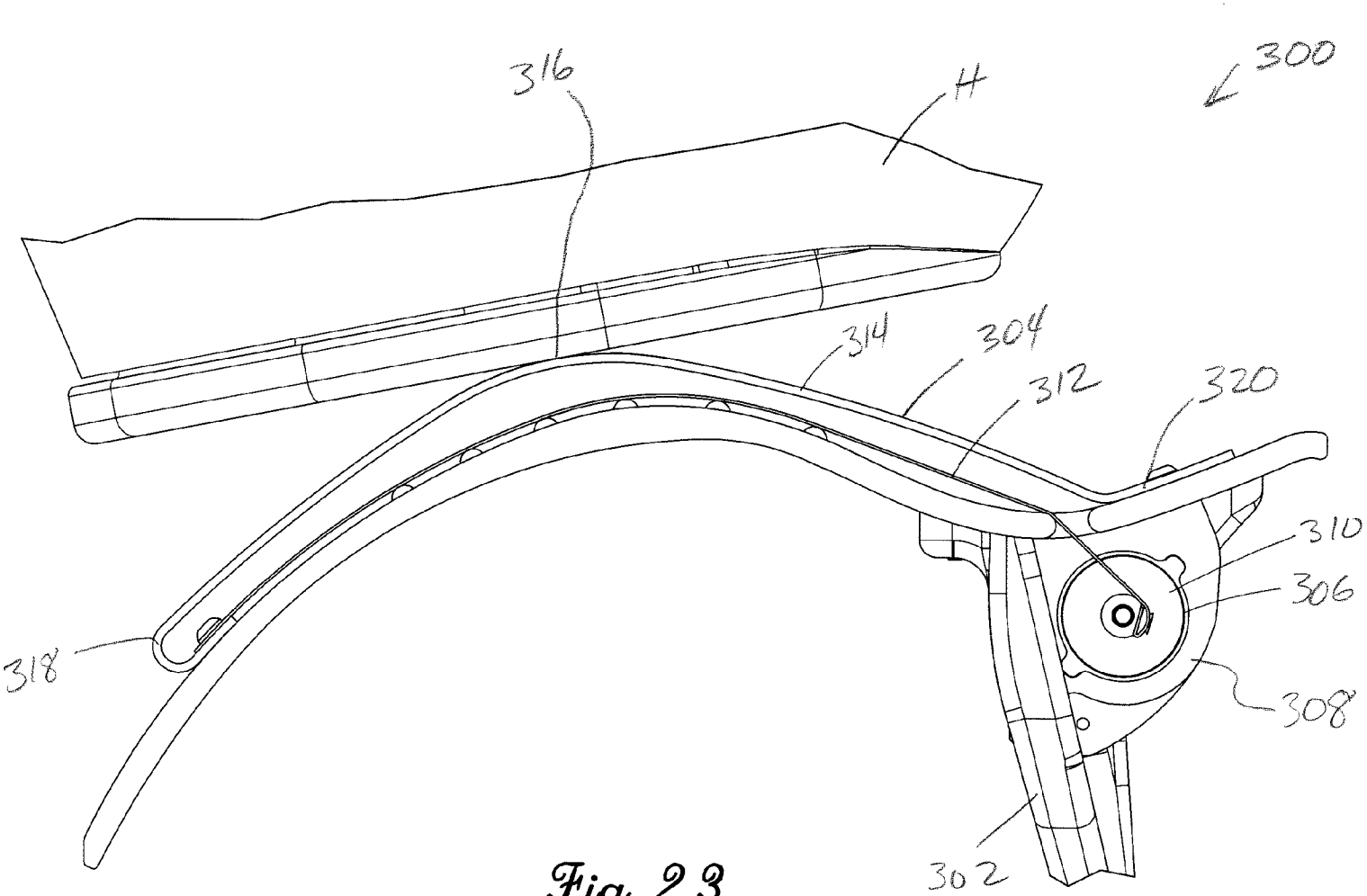

FIG. 22 is a side elevation of a helmet and motion restrictor constructed in accordance with a second preferred embodiment of the present invention, showing a harness, helmet-engaging component, and centrifugal brake assemblies of the motion restrictor, with the helmet-engaging component including a pair of flexible leaf spring elements in an upper position; and FIG. 23 is a side elevation of the helmet and motion restrictor similar to FIG. 22, but showing the leaf spring elements flexed downwardly by the helmet, with a strap of one of the centrifugal brake assemblies being unwound from the spool.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
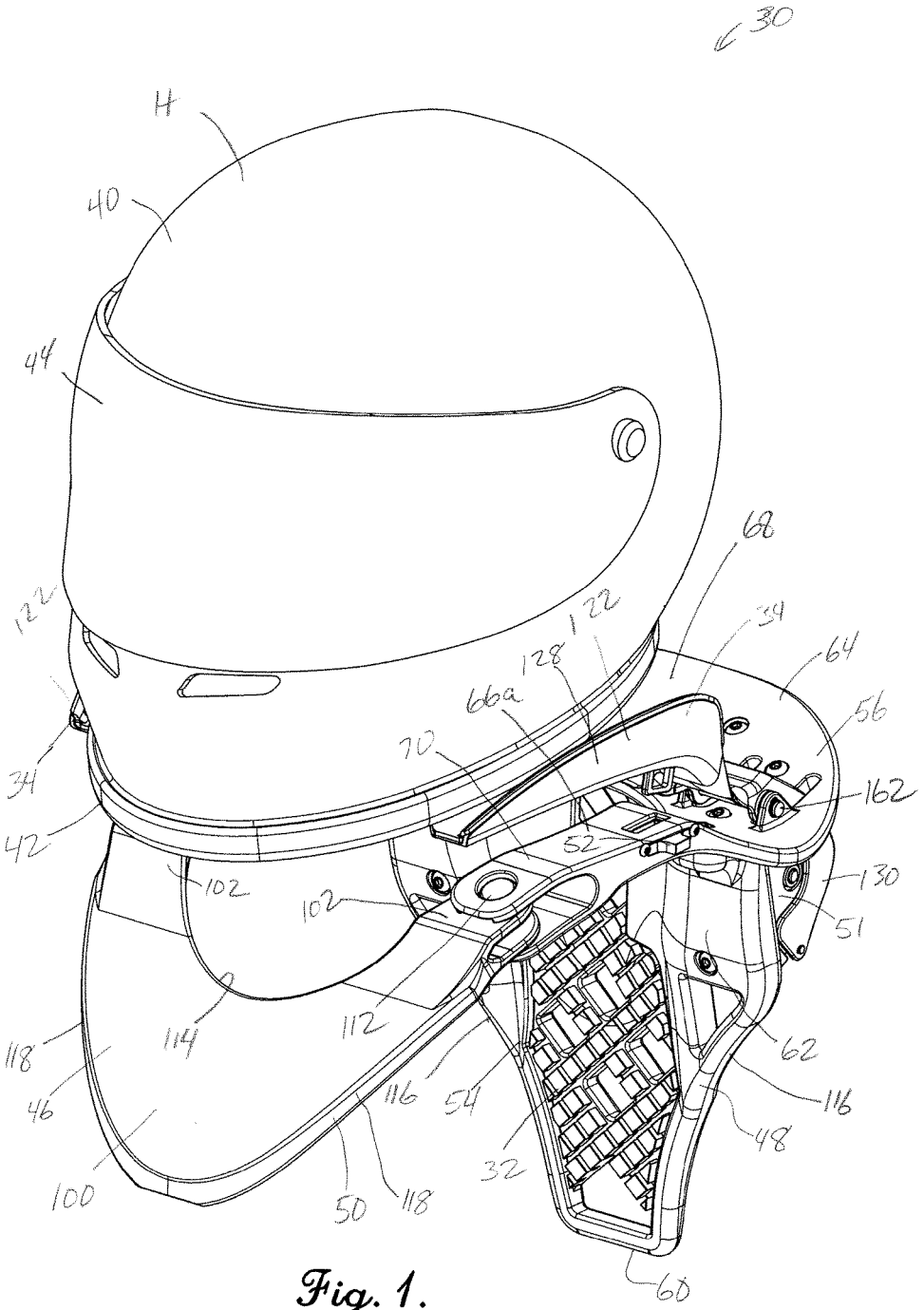
FIG. 1 is a front perspective of a helmet and a motion restrictor, with the motion restrictor being constructed in accordance with a first preferred embodiment of the present invention.
Figure 2:
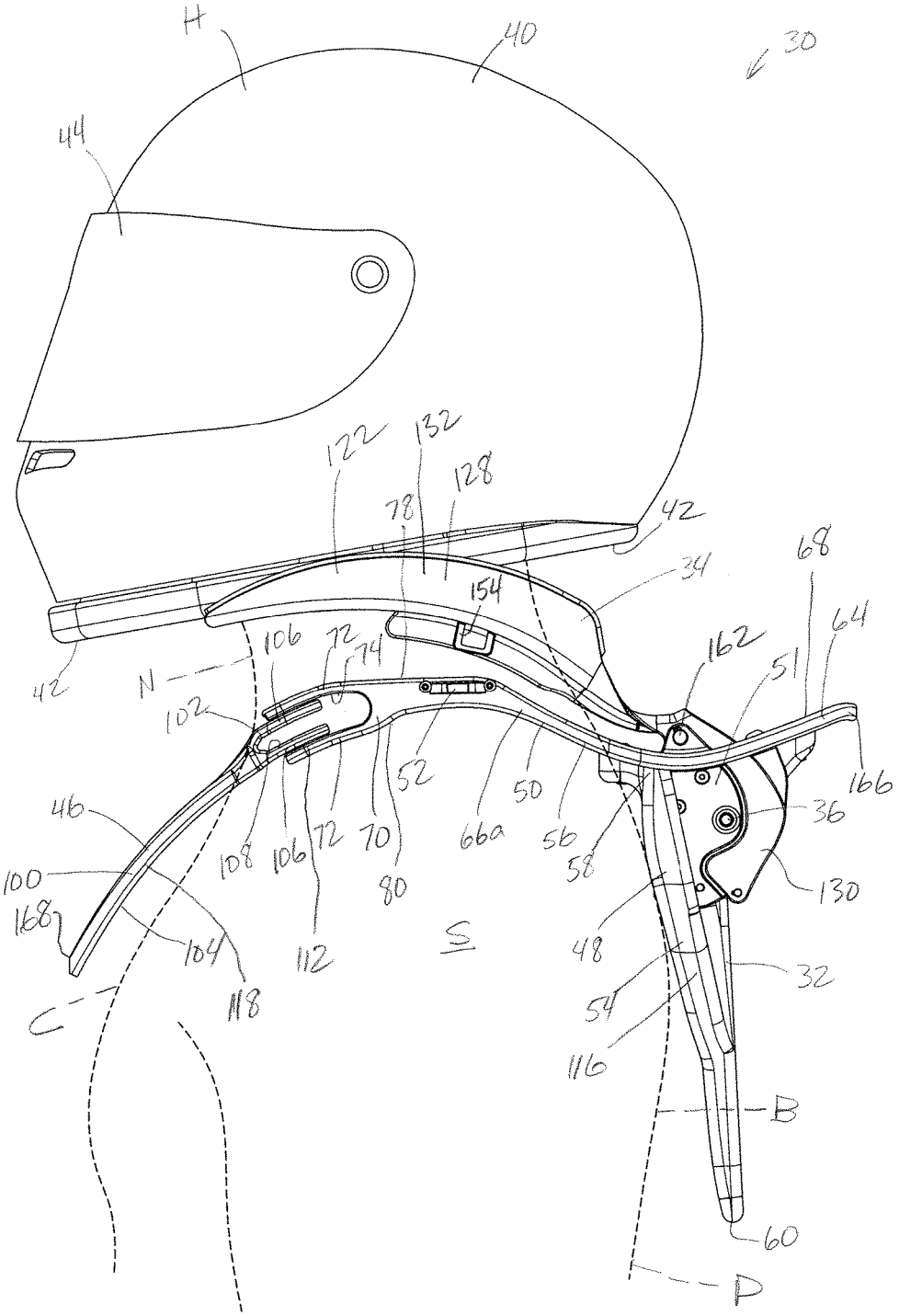
FIG. 2 is a side elevation of the helmet and motion restrictor shown in FIG. 1, showing the helmet and motion restrictor donned by a user in a normally upper position.

Turning initially to FIGS. 1 and 2, a motion restrictor 30 is constructed in accordance with a preferred embodiment of the present invention. The motion restrictor 30 is configured to be worn by a user P to control the movement of a helmet H when the helmet H is exposed to excessive acceleration and/or external force. More particularly, the motion restrictor 30 is configured to decelerate and stop the helmet H in response to excessive acceleration and/or external force, particularly when the acceleration or force could lead to injury of the user. For instance, the motion restrictor 30 is configured to be worn by the user P when the user P wears the helmet H while riding a vehicle (e.g., an off-road vehicle such as a bicycle, motorcycle, all terrain vehicle (ATV), automobile, etc.). It will be appreciated by those of ordinary skill in the art that the user P can be exposed to excessive acceleration and/or external forces when the vehicle (not shown) travels over terrain that is undulating or rough, or includes various obstacles (such as a ridge, gulley, terrace, rock, brush, snow, mud, etc.), or during a crash of the vehicle.

However, the principles of the present invention are applicable for a user P who participates in an another type of physical activity while wearing a helmet, particularly where the activity involves some risk of bodily injury to the user P. For instance, various features of the present invention are applicable where the user P wears a helmet and participates in a sporting activity other than riding a vehicle, such as snow skiing, ice hockey, or football.

As will be discussed, the motion restrictor 30 is preferably configured to decelerate and stop the helmet H and control helmet motion without being a continuous or permanent connection to the helmet H. The motion restrictor 30 preferably includes a harness 32, a helmet-engaging component 34, centrifugal brake assemblies 36, and an electronic controller 38.

The helmet H comprises a conventional motorcycle safety helmet that is donned by the user P to cover and protect the user's head (not shown). In the usual manner, the helmet H serves to restrict an external object from directly contacting the user's head. Furthermore, the helmet H generally distributes and dampens an external force applied to the helmet H.

The helmet H includes a continuous shell 40 that presents a face opening (not shown), a lowermost margin 42 at the bottom of the shell 40, and a neck opening (not shown) defined by the lowermost margin 42. The helmet H also includes an adjustable visor 44 that is shiftable into and out of a covering position (see FIG. 1) where the visor 44 covers the face opening.

However, it is within the scope of the present invention where an alternative helmet is worn by the user P and used in connection with the motion restrictor 30.

Turning to FIGS. 1-5, the harness 32 is configured to support and position the motion restrictor 30 relative to the user's head when the motion restrictor 30 is donned by the user P. The harness 32 also preferably serves to limit at least some movement of the helmet H. For instance, the harness 32 is preferably configured to engage the helmet H during excessive neck extension. The harness 32 preferably includes forward and aft sections 46 and 48, respectively, that are removably connected to one another. In the illustrated embodiment, the sections 46,48 cooperatively form a relatively rigid and substantially continuous collar 50 to surround the neck of the user P. The harness 32 also preferably includes a centrifugal brake housing 51 and a locking retainer assembly 52.

The illustrated aft section 48 preferably includes a back panel 54 and a shoulder support 56 that are integrally formed with one another to define a unitary and generally rigid structure. The back panel 54 presents upper and lower margins 58 and 60 (see FIG. 2) and has a generally upright structure that extends between the upper and lower margins 58 and 60. The back panel 54 presents a generally upright and forward-facing back positioning surface 62 (see FIG. 1) that is configured to contact and extend vertically along the user's back B. However, it will be appreciated that the harness 32 could include an alternative structure to engage and position the harness 32 relative to the back B.

Figure 3:
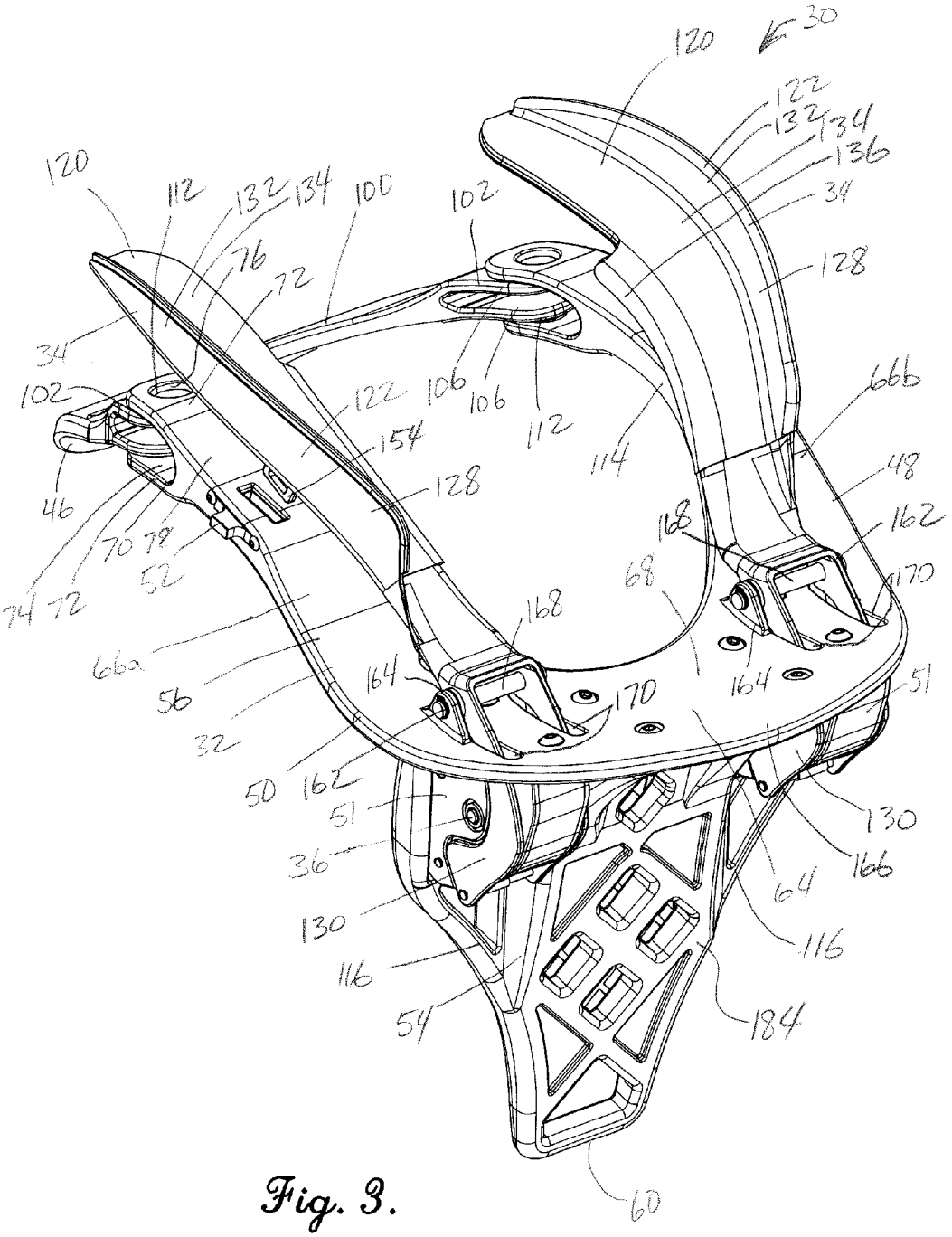
FIG. 3 is an upper rear perspective of the motion restrictor shown in FIGS. 1 and 2, showing a harness, a helmet-engaging component, and centrifugal brake assemblies of the motion restrictor, with the helmet-engaging component including a pair of levers in an uppermost position adjacent and above the normally upper position.
Figure 4:
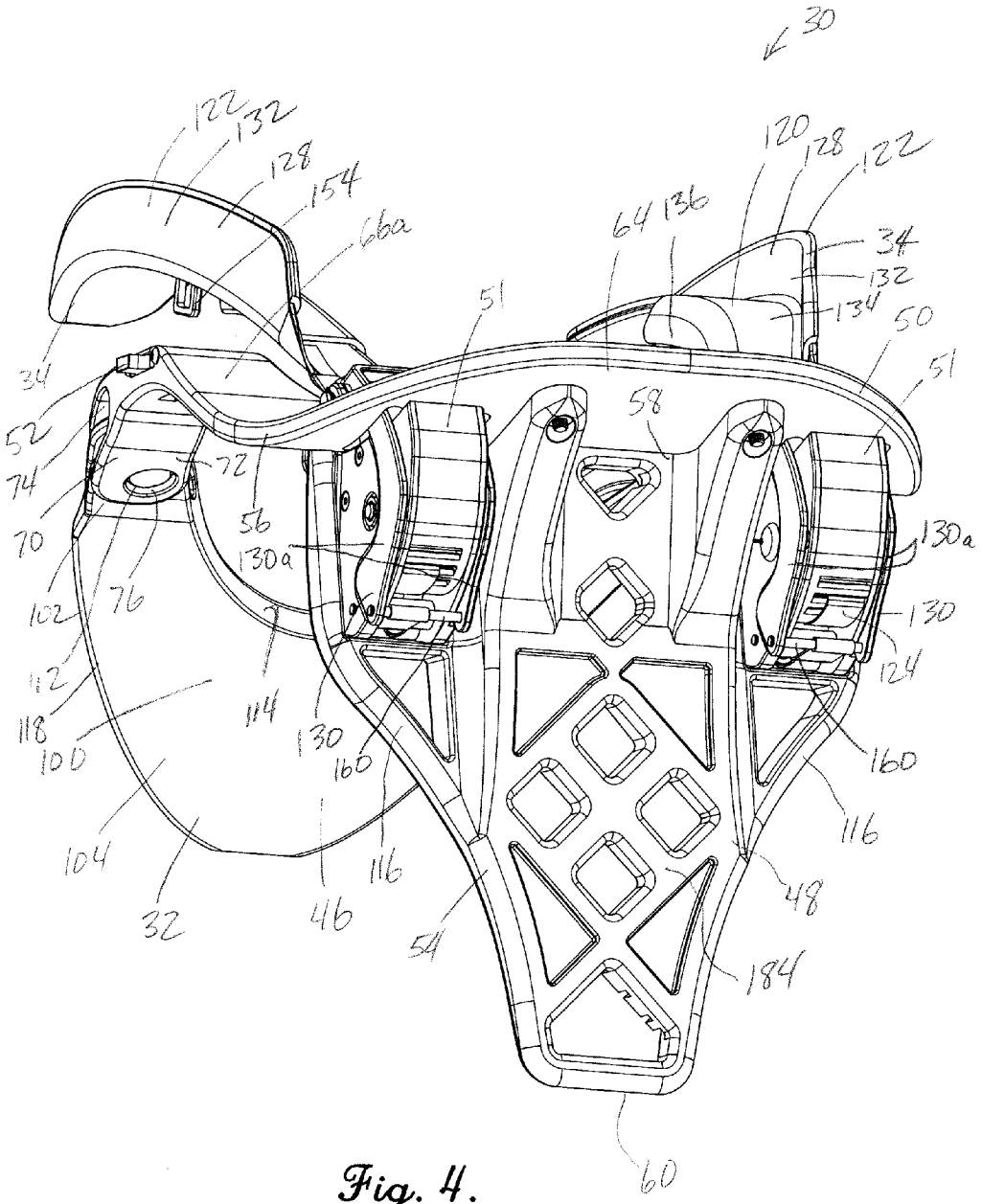
FIG. 4 is a lower rear perspective of the motion restrictor shown in FIGS. 1-3.
Figure 5:
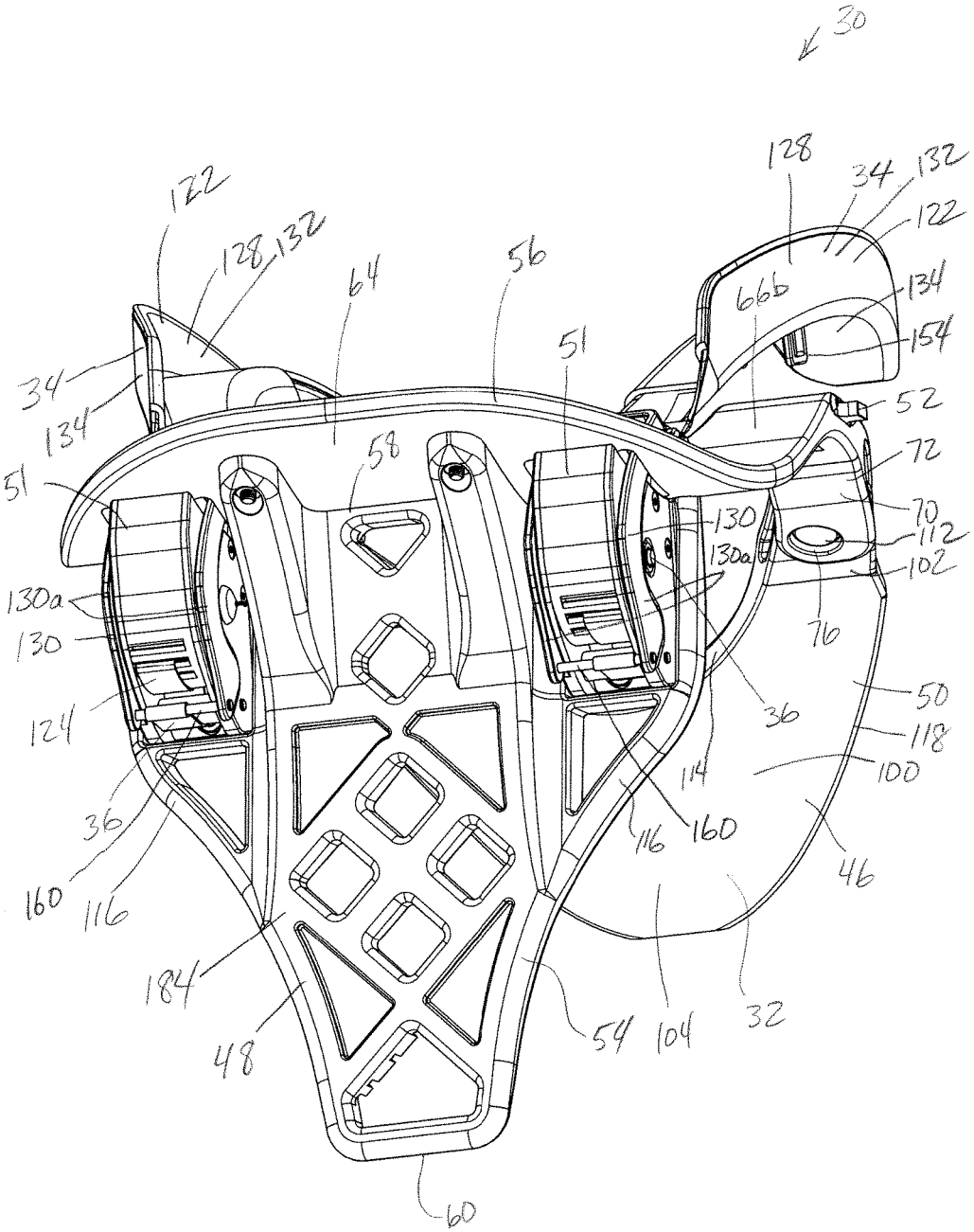
FIG. 5 is another lower rear perspective of the motion restrictor shown in FIGS. 1-4.

The shoulder support 56 is unitary and preferably includes an aft plate 64 and shoulder plates 66*a,b* (see FIG. 3). The aft plate 64 projects generally rearwardly from the upper margin 58 of the back panel 54. The shoulder plates 66 project forwardly from the aft plate 64 and the upper margin 58 of the back panel 54 and are configured for placement on top of the user's shoulders S.

The aft plate 64 is preferably curved to define a generally concave shaped upper stop surface 68 (see FIG. 3). When the harness 32 is donned by the user P, the stop surface 68 is operable engage the helmet H during excessive neck extension by the user P. That is, the stop surface 68 preferably serves to limit the amount of neck extension by the user P.

However, it will be appreciated that the aft plate 64 could be alternatively configured without departing from the scope of the present invention.

Turning to FIGS. 1-5 and 18, the shoulder plates 66*a,b* are each elongated and include female connectors 70 that define forwardmost ends of the aft plate 64. The female connectors 70 each include tabs 72 that cooperatively define a slot 74 and present holes 76 (see FIGS. 3 and 18). Each shoulder plate 66 presents upper and lower surfaces 78 and 80 (see FIG. 18). Each shoulder plate 66 also presents a lateral socket 82 and an upright slot 84 that intersect one another (see FIGS. 18-20). As will be discussed, the socket 82 is configured to operably receive the retainer assembly 52.

When the harness 32 is donned by the user P, the shoulder plates 66 are configured to rest on the user's shoulders S so that the lower surfaces 80 are engaged with the shoulders S. However, the harness 32 could include an alternative structure to engage and position the harness 32 relative to the shoulders S.

Figure 18:
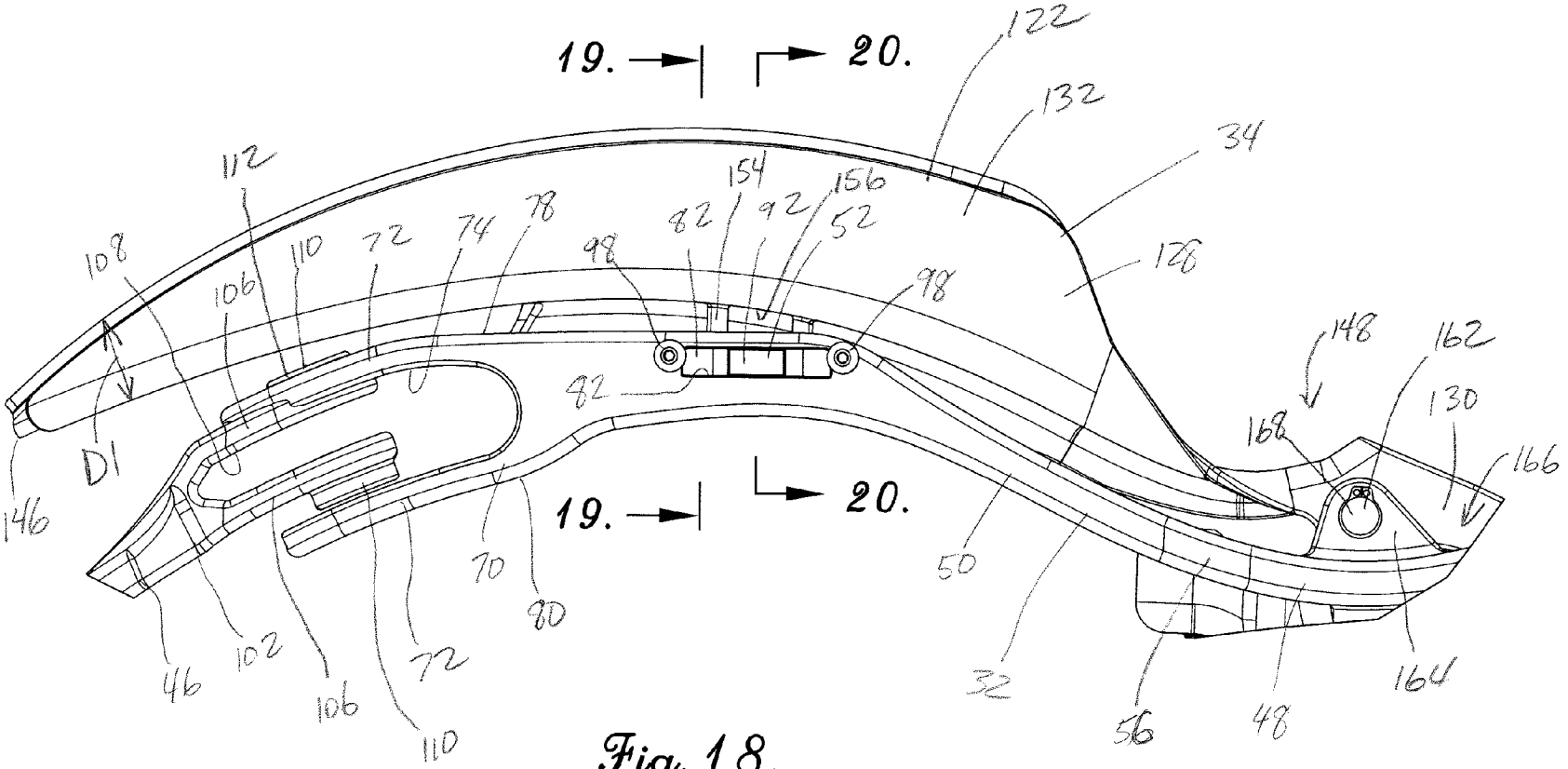
FIG. 18 is an enlarged framentary side elevation of the motion restrictor shown in FIGS. 1-17, showing the levers in a stored position adjacent the lowermost position, with a catch of the levers projecting downwardly into shoulder plates of the harness.
Figure 20:
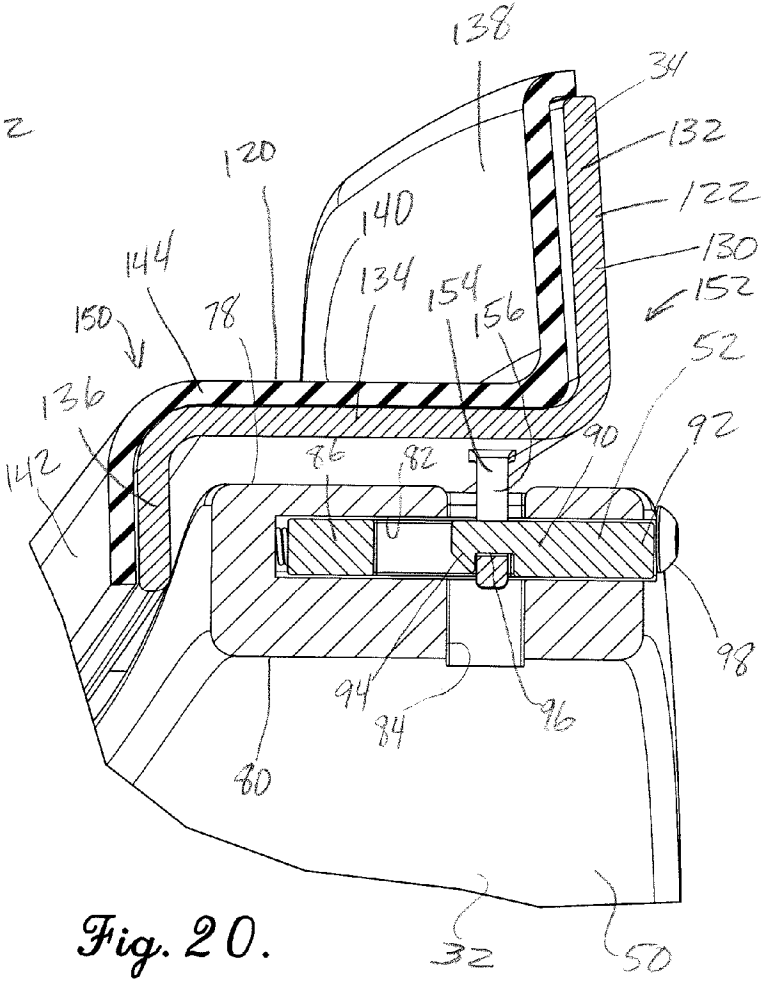
FIG. 20 is a cross section of the motion restrictor taken along line 20-20 in FIG. 18, showing the latch received by a slot of the catch.
Figure 19:
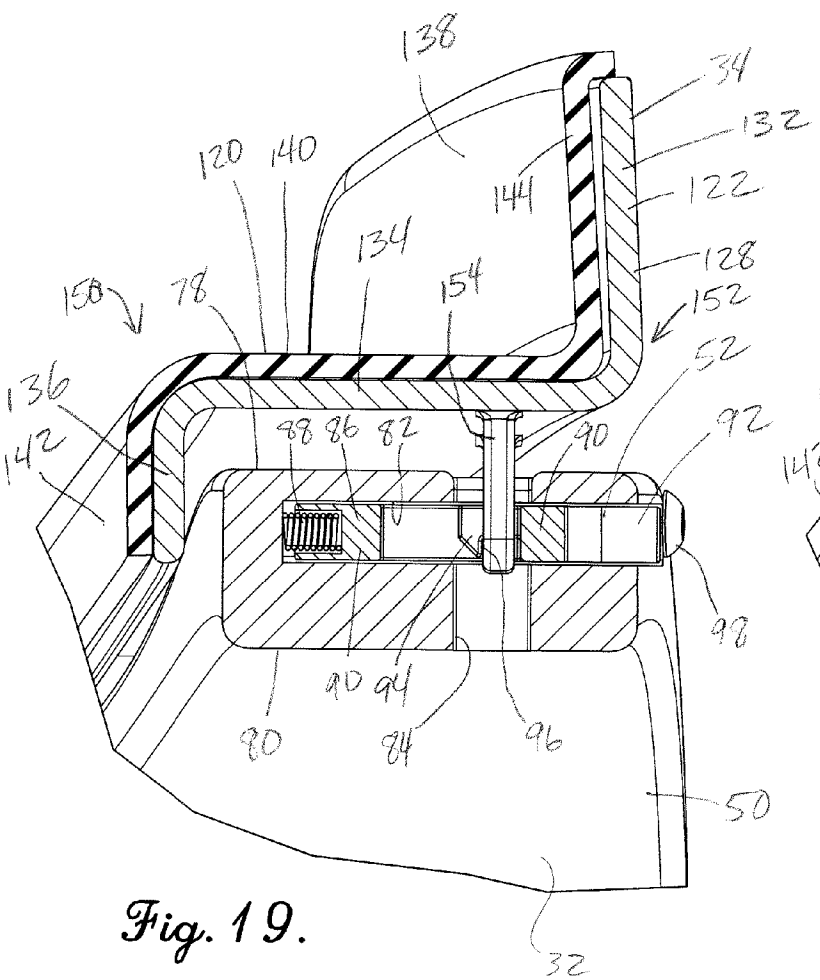
FIG. 19 is a cross section of the motion restrictor taken along line 19-19 in FIG. 18, showing a latch of the harness that engages the catch and thereby secures the lever in the stored position.

Turning to FIGS. 18-20, each retainer assembly 52 preferably includes a latch 86 and a pair of springs 88 mounted alongside one another in the socket 82. The latch 86 includes a latch body 90, a tab 92, and a tooth 94. The latch body 90 and tooth 94 cooperatively define a downward-facing slot 96.

The latch 86 is removably retained in the socket 82 with threaded fasteners 98. The latch 86 is slidable within the socket 82 along a lateral direction between a latched position (see FIGS. 19 and 20) and an unlatched position (see FIGS. 3-5). The springs 88 are configured and positioned to bias the latch 86 into the unlatched position. The springs 88 also permit the latch 86 to be shifted toward the latched position by pushing the tab 92 in an inboard direction. As will be discussed, the retainer assemblies 52 are configured to removably engage the helmet-engaging component 34.

The back panel 54 and shoulder support 56 of the aft section 48 preferably include a synthetic resin material. More preferably, the back panel 54 and shoulder support 56 include a carbon fiber composite material having carbon fiber. While not shown, the aft section 48 also preferably includes a metal framework around which the composite material is formed. Such metal components can include carbon steel, stainless steel, aluminum, and/or titanium. It is within the ambit of the present invention for the aft section 48 to alternatively include one or more types of synthetic resin materials and/or one or more types of metal materials.

Turning again to FIGS. 1-5 and 18, the forward section 46 preferably comprises a unitary structure that includes a breastplate 100 and male connectors 102. The forward section 46 presents a chest positioning surface 104 that is configured to contact and extend vertically along the user's chest C. The male connectors 102 define aft ends of the forward section 46. Each male connector 102 includes tabs 106 that are positioned adjacent to one another and cooperatively define a slot 108. The male connector 102 also includes studs 110 (see FIG. 18) integrally formed with the tabs 106.

The forward section 46 preferably includes a synthetic resin material. More preferably, the forward section 46 includes a carbon fiber composite material having carbon fiber. While not shown, the forward section 46 also preferably includes a metal framework around which the composite material is formed. Such metal components can include carbon steel, stainless steel, aluminum, and/or titanium. It is within the ambit of the present invention where the forward section 46 includes one or more types of synthetic resin materials and/or one or more types of metal materials.

The forward section 46 is removably attached to the aft section 48 by inserting the male connectors 102 within the slots 74 presented by the female connectors 70. The male connectors 102 are removably attached by fitting the studs 110 within corresponding ones of the holes 76 to form a joint 112 (see FIGS. 1 and 2). In particular, the tabs 106 of male connectors 102 can be yieldably flexed toward each other, into a flexed position (see FIG. 18), to permit insertion of the male connector 102 within the female connector 70. Once the studs 110 are aligned with holes 76, the tabs 106 are permitted to move away from each other, and out of the flexed position, so that the studs 110 engage the holes 76. Specifically, the yieldable flexing of the tabs 106 in the flexed position urges the tabs 106 to move out of the flexed position.

When attached to one another, the back panel 54, shoulder plates 66, and breastplate 100 cooperatively define the collar 50. The collar 50 presents a central neck opening 114 configured to receive the neck N of the user P. The collar 50 preferably extends endlessly about the neck opening 114. However, the harness 32 could be alternatively configured to define the neck opening 114 without departing from the scope of the present invention. For example, in regard to some aspects of the present invention, the collar need not be continuous, with one or more of the panel and plates including spaced apart sections or being wholly removed.

The harness 32 also preferably includes a pair of webbing straps (not shown) to interconnect the sections 46,48. Specifically, the straps are attached to corresponding side margins 116 of the back panel 54. When secured, the straps extend generally horizontally and in a forward direction from the back panel 54 for removable attachment to corresponding side margins 118 of the forward section 46.

The straps are sized and configured to snugly secure the harness 32 on the user P while restricting harness movement relative to the user P. For instance, the straps serve to restrict upward movement of the harness 32. In particular, the straps are sized and configured to flex the forward section 46 and/or aft section 48 so that the forward section 46 moves toward the back panel 54. Generally, each strap passes between a corresponding arm of the user P and the user's torso so that the strap passes below the user's armpit. However, it will be appreciated that the harness 32 could have alternative structure to restrict the harness 32 from moving relative to the user P. In addition, the harness 32 may alternatively be devoid of any stops or other tie-down structure, such that the collar simply rests on the user P.

The harness 32 is preferably configured for convenient and efficient donning and removal by the user P. To don the harness 32, the sections 46,48 can be entirely detached from each other to permit free movement of the sections 46,48 independently of each other. With the sections 46,48 detached, the user P can position the sections 46,48 adjacent to one another and along opposite sides of the neck N. Each male connector 102 of the forward section 46 can then be brought into engagement with a corresponding one of the female connectors 70 of the aft section 48. The male connectors 102 can be engaged with the female connectors 70 simultaneously or one at a time.

The harness 32 can be alternatively donned by initially engaging one of the male connectors 102 with the corresponding one of the female connectors 70. With one pair of male and female connectors 102,70 attached to each other, the joint 112 preferably acts as a hinge that permits relative rotational movement between the male and female connectors 102,70 and, consequently, the forward and aft sections 46,48. With the one pair of male and female connectors 102,70 attached to each other, the sections 46,48 cooperatively define an open passage (not shown) that provides access to the neck opening 114. The sections 46,48 can be swung relative to each other to selectively increase or decrease the size of the open passage.

To don the harness 32 with one pair of connectors attached, the sections 46,48 are swung so that the neck N of user P can move through the open passage. With the neck N received in the neck opening 114, the other pair of male and female connectors 102,70 can be swung toward each other to close the open passage. The male and female connectors 102,70 can then be engaged to secure the harness 32 around the user's neck N.

The principles of the present invention are equally applicable for use with an alternative harness construction. For instance, the harness 32 could be configured to for mounting in an alternative position on the user's torso (e.g., where harness components other than the straps extend about the torso below the shoulders S).

Turning to FIGS. 1-5 and 18-20, the helmet-engaging component 34 of the motion restrictor 30 is configured to engage the helmet H and to decelerate and stop the helmet H in response to an injurious level of helmet movement. As will be discussed, the component 34 preferably presents laterally spaced apart, fore-and-aft extending helmet-engagement surfaces 120 positioned on opposite sides of the neck N of the user P when the motion restrictor 30 is donned. Furthermore, the component 34 is configured so that the helmet-engagement surfaces 120 can shift along a range of motion while in contact with the helmet H as the helmet H moves. To keep the surfaces 120 in contact with the helmet H, the component 34 is configured to yieldably bias each of the helmet-engagement surfaces 120 toward the helmet when the motion restrictor 30 is donned. As a result, the surfaces 120 are maintained in contact with the helmet H as they shift through the range of motion.

Figure 7:
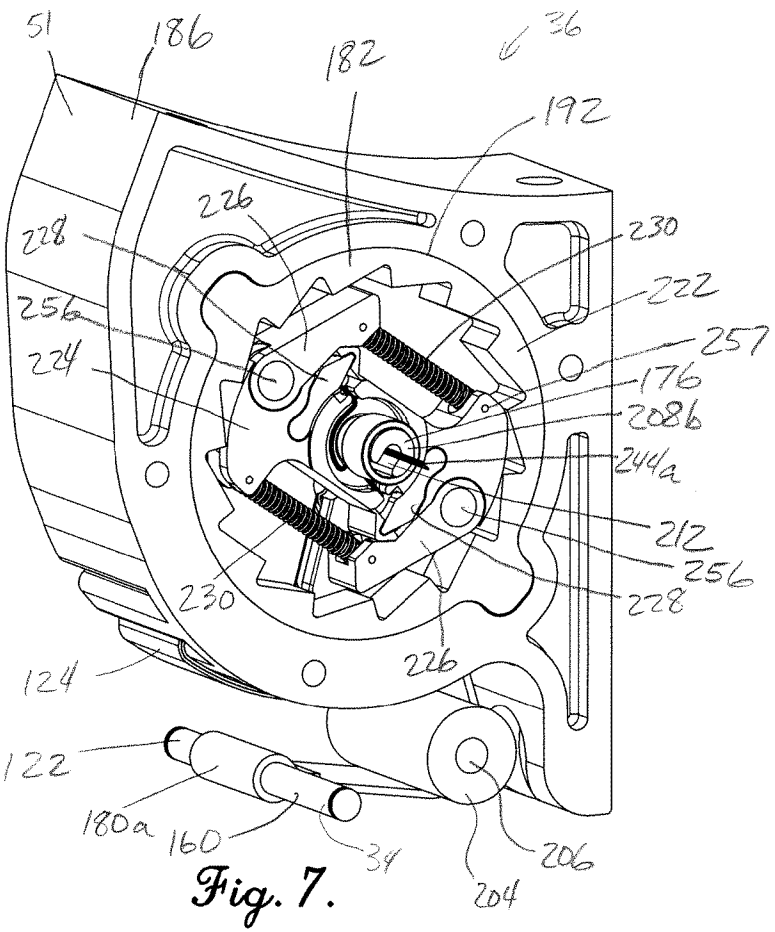
FIG. 7 is a fragmentary perspective of the motion restrictor similar to FIG. 6, but taken from the opposite side of the centrifugal brake assembly to show a brake member assembly mounted within the housing, with the brake member assembly including a rotatable frame, pawls, springs, and an annular body, and with the pawls being in a retracted position.

Importantly, the motion restrictor 30 preferably contacts the helmet H and decelerates the helmet H without being permanently or continuously connected to the helmet H. More particularly, the component 34 contacts the helmet H and controls helmet movement while being otherwise disconnected from the helmet H. The illustrated component 34 preferably includes a pair of levers 122, resilient bands 124, and pins 126 (see FIGS. 6-8).

The illustrated levers 122 and other components related to the levers 122 (such as components associated with the brake assemblies 36) are provided in pairs, which are generally a mirror image of one another and include similar features. Thus, when referring to the pair of levers 122 and the pairs of related components, only one of the pair of components will generally be described in detail, with the understanding that the other one of the components is similarly constructed.

The lever 122 is configured to be brought into abutting engagement with the helmet H, with the corresponding surface being yieldably biased toward the helmet H. Each lever 122 has a unitary construction and preferably includes a lever body 128 and a stop-arm 130.

The lever body 128 preferably includes a helmet-contacting upstanding wall 132, a helmet-contacting lateral wall 134 that projects inwardly from upstanding wall, and a depending wall 136 that projects downwardly from the lateral wall 134 (see FIGS. 19 and 20).

The upstanding wall 132 and lateral wall 134 present, respectively, an upstanding surface portion 138 of the helmet-engagement surface 120 and a lateral surface portion 140 of the helmet-engagement surface 120 (see FIGS. 19 and 20). The depending wall 136 presents a depending surface portion 142 (see FIGS. 19 and 20). The surface 120 is configured to slidably contact the helmet H. Preferably, the surface 120 includes a low friction coating 144 (see FIGS. 19 and 20), which enhances relative sliding between the surface 120 and helmet H. The coating 144 may be formed of any suitable material, such as Teflon®. The depending surface portion 142 also preferably includes the low friction coating 144.

The lateral wall 134 is preferably curved so that the lateral surface portion 140 has a curvilinear upwardly convex shape. The lateral wall 134 is elongated and presents a longitudinal axis that extends generally fore and aft. The lateral wall 134 presents a forwardmost anterior margin 146 and a rearmost posterior margin 148 (see FIG. 18). The lateral wall 134 extends laterally to present a medial (i.e., innermost) edge 150 and a lateral (i.e., outermost) edge 152 (see FIGS. 19 and 20).

The upstanding wall 132 projects upwardly from the lateral edge 152 and presents a variable wall height dimension D1 (see FIG. 18). More preferably, the wall height dimension D1 along a forwardmost portion of the upstanding wall 132 tapers toward the anterior margin 146. The tapered shape of the forwardmost portion permits the user P to rotate the user's head and helmet H about the upright axis of the neck N and restricts interference between the helmet H and the lever 122 during such rotation. Moreover, the forwardmost portion acts as a cam as the head is turned. More particularly, as the user's head turns to the side, the lower margin of the helmet H slidably engages the forwardmost portion of the upstanding wall 132 and moves the lever 122 downwardly. However, it is within the ambit of the present invention where the upstanding wall 132 is alternatively shaped (e.g., to permit a free range of sliding and/or rotational helmet movement). Yet further, as will be shown in a subsequent embodiment, the helmet-engaging component could be devoid of an upstanding wall.

The depending wall 136 projects downwardly from the medial edge 150. The depending wall 136 preferably allows the user's neck N to contact the lever 122 and restricts neck discomfort and/or injury during such contact. While not being preferred, the depending wall 136 could possibly come into contact with the helmet H if the lowermost margin 42 slips below the lateral wall 134. In such an event, the low friction coating 144 permits the helmet H to easily slide upwardly relative to the lever body 128 for repositioning in sliding engagement with the lateral surface portion 140 and/or upstanding surface portion 138.

The lever body 128 also preferably includes a catch 154 that depends from the lateral wall 134 and presents a catch opening 156 (see FIGS. 18 and 20). As will be explained, the retainer assembly 52 is configured to removably engage the catch 154 and thereby releasably retain the lever 122 in a stored position.

In the preferred embodiment, the stop-arm 130 is integrally formed with the lever body 128 and connects the lever body 128 to the respective centrifugal brake assembly 36 and control lever movement. The stop-arms 130 each preferably include a pair of plate sections 130*a* (see FIGS. 4 and 5) that are positioned alongside each other in a generally parallel relationship. The stop-arms 130 also include a connection pin 160 (see FIGS. 4-9) that connects the plate sections 130*a* to each other. As will be discussed, the connection pin 160 is preferably drivingly coupled to the centrifugal brake assembly 36.

The illustrated levers 122 are pivotally mounted to the harness 32 at pivots 162 to swing through a range of positions. As a result, each lever 122 permits the respective helmet-engagement surface 120 to swing through a corresponding range of motion in which the helmet H remains in contact with the surface 120. In the illustrated embodiment, each lever 122 swings up and down to define the range of motion of the corresponding one of the helmet-engagement surfaces 120.

The harness 32 preferably includes lugs 164 that are formed with and project upwardly adjacent to an aft margin 166 of the shoulder support 56 (see FIGS. 3 and 18). The lugs 164 are positioned on opposite sides of the neck opening 114. The lugs 164 are pivotally connected to the lever 122 with a pivot pin 168 (see FIGS. 3 and 18). When mounted to the harness 32, the lever body 128 projects forwardly from the pivot 162 and is generally positioned above the shoulder plate 66 of the harness 32. The stop-arms 130 project rearwardly and downwardly from the pivot 162 and extend through slots 170 presented by the aft section 48 (see FIG. 3).

The pivots 162 are preferably located adjacent to the aft margin 166 of the harness 32. However, the pivots 162 could be positioned at a forward margin 174 (see FIG. 2) of the harness 32 or at a location between the forward and aft margins 174,166.

The illustrated helmet-engagement surfaces 120, are preferably located on opposite sides of the neck opening 114. Furthermore, the preferred helmet-engagement surfaces 120 are each positioned outboard from the neck opening 114 in opposite lateral directions. However, the surfaces 120 could be alternatively positioned without departing from the scope of the present invention.

As will be discussed, the levers 122 each present a corresponding surface 120. The levers 122 are preferably configured to operate independently of one another so that one lever 122 can move and decelerate the helmet H independently of the other lever 122. However, the motion restrictor 30 could have an alternative structure to engage the helmet H.

For instance, the motion restrictor 30 could have a single helmet-engaging component that extends along both sides of the neck opening 114 to present the helmet-engagement surfaces. More particularly, it is within the ambit of certain aspects of the present invention to utilize a single lever pivotally mounted at the forward or aft margin of the harness. Also, for an alternative single lever configuration, the lever body could be variously shaped to provide oppositely spaced helmet-engagement surfaces. For instance, the lever body could have a generally U-shaped structure or could have a generally endless structure with a neck opening (e.g., an elliptically-shaped lever body).

The lever 122 is configured to swing so that the lever body 128 moves into and out of an uppermost position (see FIGS. 3-5) where the lever body 128 and helmet-engagement surface 120 are swung to an uppermost limit of the range of motion. In the uppermost position, the connection pin 160 preferably engages the housing 51 of the harness 32 to restrict further upward swinging of the lever body 128 and the corresponding surface 120. As will be discussed, the band 124 is preferably configured to interconnect the lever 122 and the brake assembly 36 and to urge the lever 122 into the uppermost position.

When the helmet H and motion restrictor 30 are donned by the user P and the user's neck is in a normally relaxed and upright position, the lever body 128 preferably engages the helmet H and is shifted downwardly into a normal upper position (see FIGS. 1 and 2) immediately adjacent to and below the uppermost position.

Figure 15:
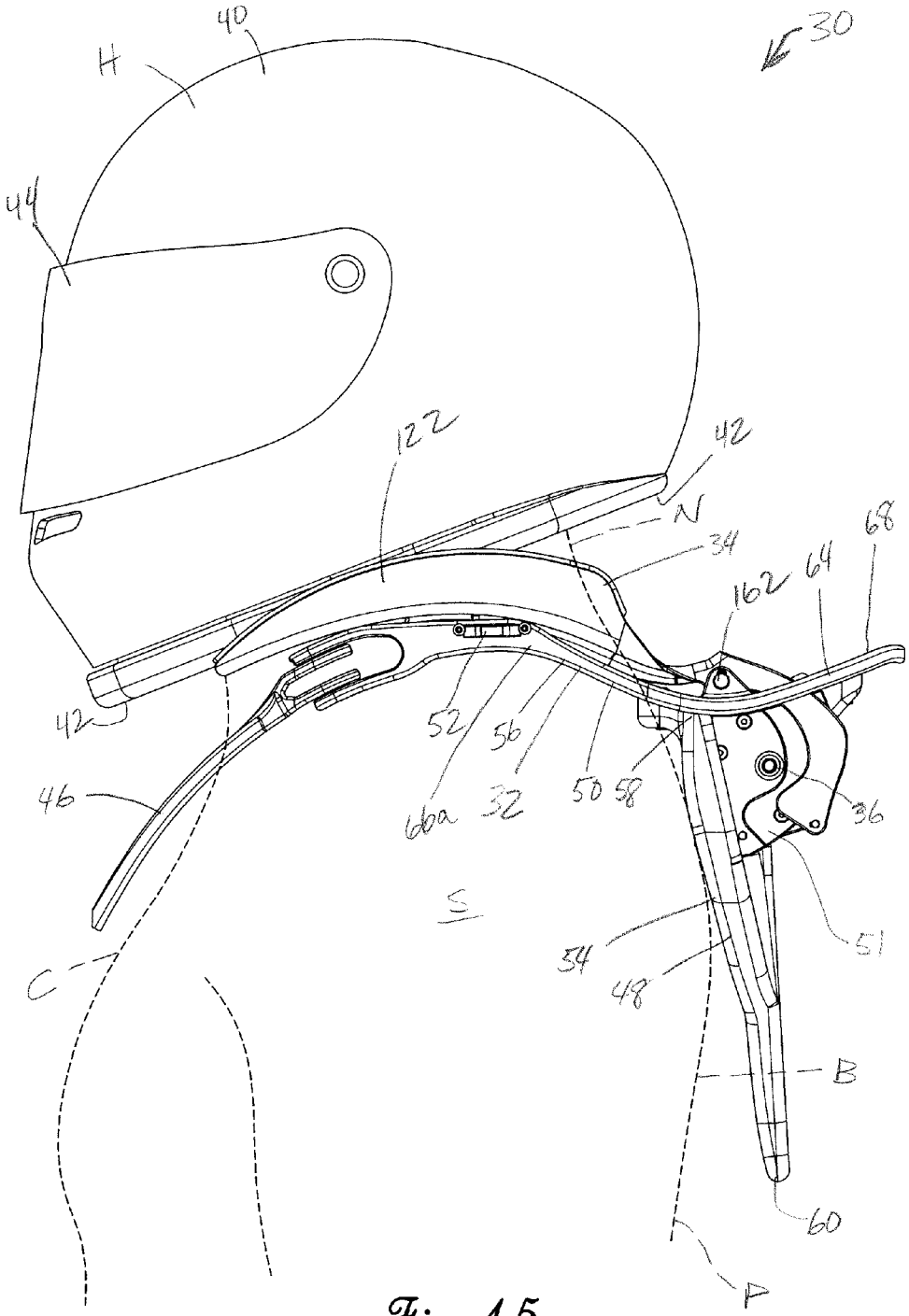
FIG. 15 is a side elevation of the helmet and motion restrictor similar to FIG. 12, but showing the helmet shifted downwardly so that the levers are shifted downwardly from the intermediate position to a lowermost position.
Figure 16:
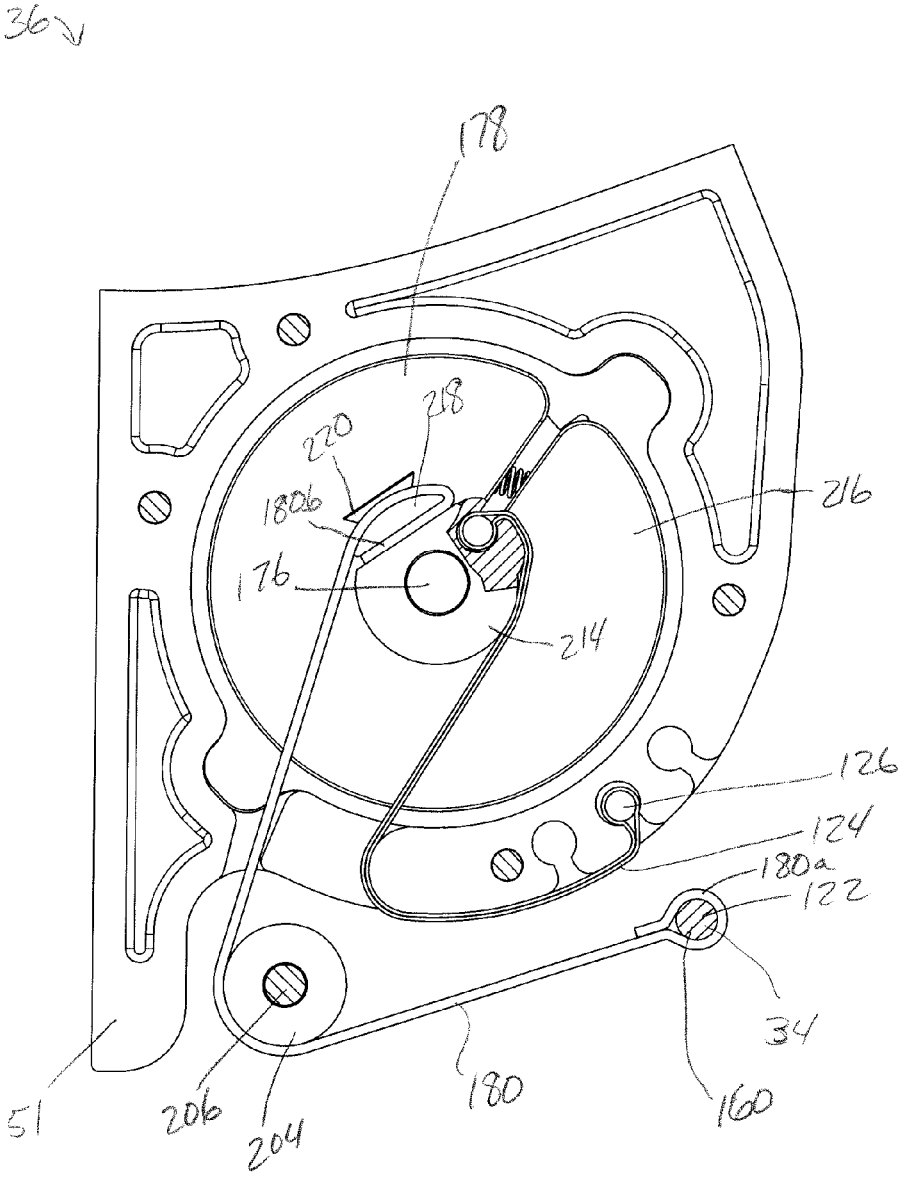
FIG. 16 is a side elevation of the centrifugal brake assembly and brake housing similar to FIG. 13, but showing the centrifugal brake assembly in a third position associated with the lowermost position of the levers, with the connecting strap being drawn out of the brake housing so that the spool is rotated in an unwinding direction from the second position to the third position.
Figure 17:
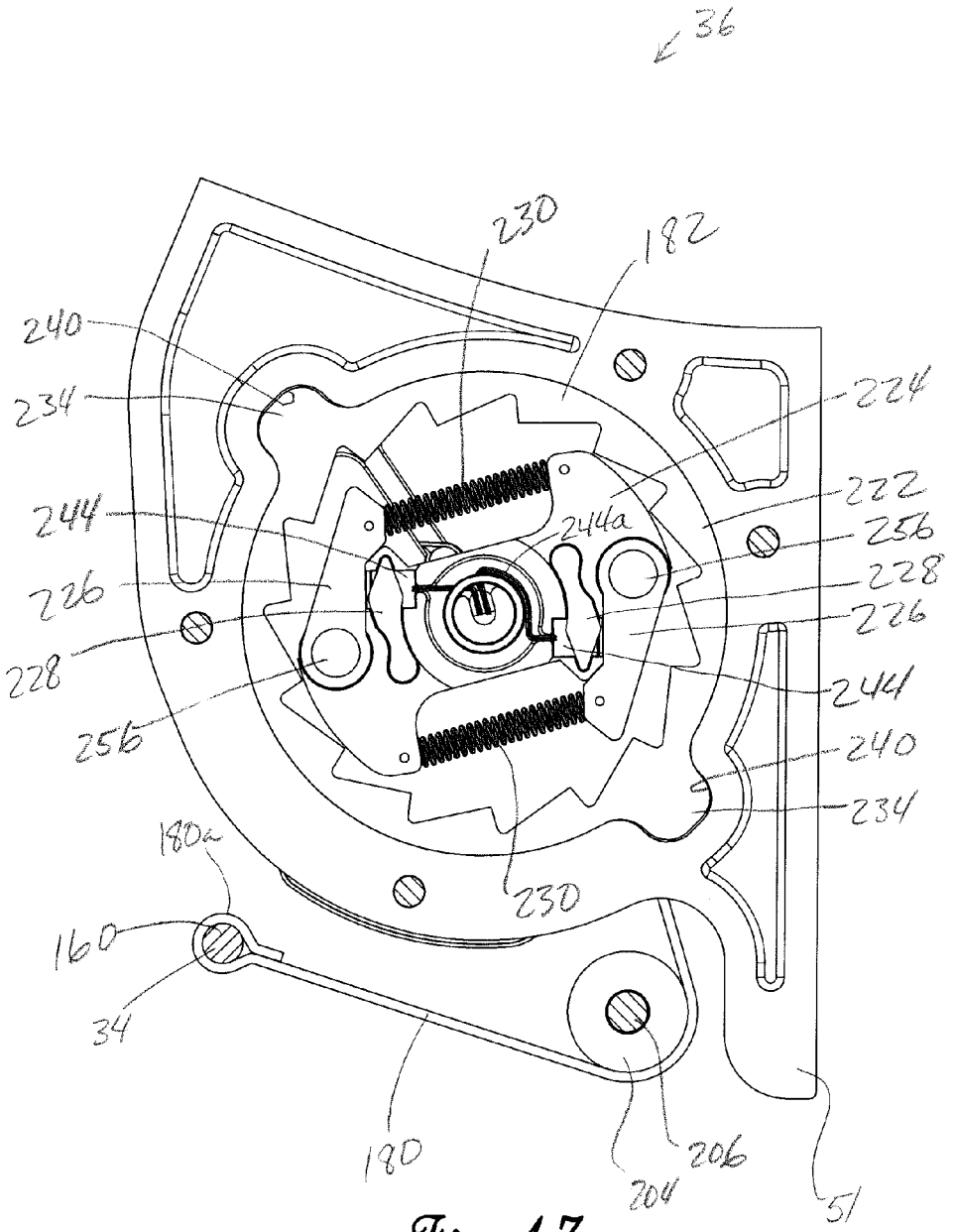
FIG. 17 is a side elevation of the centrifugal brake assembly and brake housing similar to FIG. 14, but showing the brake member assembly in the third position and the pawls in the retracted position.

Similarly, the lever 122 is configured to swing so that the lever body 128 moves into and out of a lowermost position (see FIG. 15) where the lever body 128 and helmet-engagement surface 120 are swung to a lowermost limit of the range of motion. In the lowermost position, the lever body 128 preferably engages the shoulder plate 66 to restrict further downward swinging of the lever body 128 and the corresponding surface 120.

While the lever 122 is preferably mounted to pivot between the uppermost and lowermost positions, the lever 122 could be shiftably mounted in an alternative manner without departing from the spirit of the present invention. For instance, the helmet-engaging component 34 could include a helmet-engaging body that is slidably connected to the harness 32 with a nonpivoting connection (so that the helmet-engaging body slides along an upright direction). As will be shown in a subsequent embodiment, the helmet-engaging component 34 could also flex to permit the desired movement of the helmet-engagement surfaces 120.

The levers 122 preferably include a synthetic resin material. More preferably, the levers 122 include a carbon fiber composite material having carbon fiber. While not shown, the levers 122 also preferably include a metal framework around which the composite material is formed. Such metal components can include carbon steel, stainless steel, aluminum, and/or titanium. It is within the ambit of the present invention where the lever includes one or more alternative types of synthetic resin materials and/or one or more alternative types of metal materials.

The lever 122 is preferably configured so that the lever body 128 and stop-arm 130 can flex slightly relative to one another about the lateral axis of the pivot 162. The lever 122 is configured to have some limited flexibility or "give" when the brake assembly 36 is engaged and a load is applied to the helmet-engagement surface 120. The limited flexibility of the lever 122 enables the lever 122 to absorb at least some of the load applied to the helmet-engagement surface 120.

Again, the lever 122 permits the helmet-engagement surface 120 to swing through a range of motion where the helmet H can remain in contact with the surface 120. The motion restrictor 30 is preferably configured so that the helmet H can remain in contact with the helmet-engagement surface 120 and slide along the lateral surface portion 140 and/or the upright surface portion 138 throughout the entire range of motion of the surface 120. However, for some aspects of the present invention, the full extent of surface motion may be greater than the range of motion through which the helmet H can contact the lateral surface portion 140.

Again, while the levers 122 are in contact with the helmet H, the motion restrictor 30 is preferably configured to decelerate the helmet H and control helmet motion without requiring a permanent or continuous connection with the helmet H. That is, other than the sliding contact, the levers 122 are preferably disconnected from the helmet H.

Each lever 122 is preferably configured to be removably secured in a stored position (see FIGS. 18-20) adjacent to the lowermost position. In the illustrated embodiment, this is accomplished by a corresponding one of the retainer assemblies 52. More particularly, in the stored position, the catch 154 of each lever 122 extends downwardly through the slot 84 in the shoulder plate 66. At the same time, the latch 86 extends through the catch opening 156 and engages the catch 154 (see FIGS. 19 and 20).

The lever 122 is secured in the stored position by initially shifting the lever 122 into the lowermost position. While the lever 122 is held downwardly in the lowermost position, the tab 92 of the latch 86 can be pressed (e.g., by user P) to shift the latch 86 laterally. Specifically, the latch 86 is shifted so that the tooth 94 is inserted through the catch opening 156 and the latch 86 is moved laterally into the latched position (see FIGS. 19 and 20). The lever 122 is then released so that the lever body 128 moves slightly upwardly. As a result, the catch 154 moves upwardly into engagement with the slot 96 by the lever 122 so that the lever 122 assumes the stored position (see FIGS. 19 and 20).

Engagement between the latch 86 and the catch 154 restricts the lever body 128 from shifting upwardly relative to the harness 32 and restricts the catch 154 from shifting laterally out of the latched position. Consequently, the lever 122 is removably retained in the stored position adjacent the harness 32 by removable engagement between the latch 86 and the catch 154.

The lever 122 can be released from the stored position by shifting the lever body 128 downwardly toward the lowermost position until the catch 154 is disengaged from the slot 96 of the latch 86. With the catch 154 disengaged, the springs 88 urge the latch 86 to shift laterally out of the catch opening 156 and into the unlatched position.

While the illustrated helmet-engaging component 34 is preferred, various aspects of the component 34 could be altered without departing from the scope of the present invention (e.g., while providing helmet-engagement surfaces similar to surfaces 120). For instance, as will be disclosed in a subsequent embodiment, the helmet-engaging component could have a yieldably flexible structure that presents a pair of helmet-engagement surfaces on opposite sides of the neck opening.

Turning to FIGS. 6-11, in the illustrated embodiment, each centrifugal brake assembly 36 provides a preferred braking mechanism that restricts shifting a corresponding one of the helmet-engagement surfaces 120 along the range of motion in response to injurious movement of the helmet H. Each illustrated brake assembly 36 is operably received by the housing 51 and preferably includes an axle 176, spool 178, connecting strap 180, and brake member assembly 182.

The centrifugal brake housing 51 preferably comprises a generally rigid structure that supports and encloses the brake assembly 36. The housing 51 is preferably fixed to a rear surface 184 (see FIG. 3) of the back panel 54.

Figure 10:
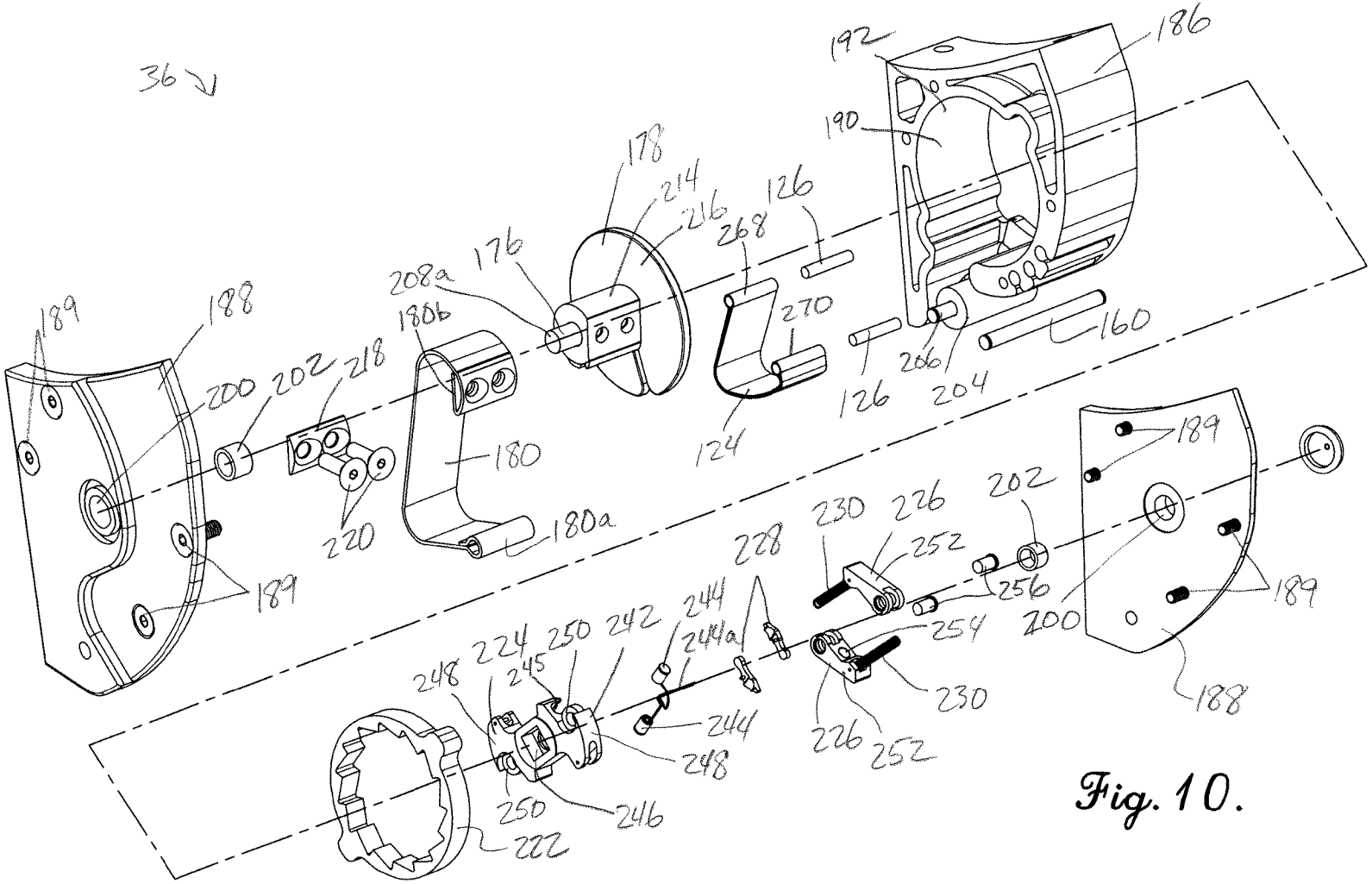
FIG. 10 is an exploded perspective of the centrifugal brake assembly and brake housing shown in FIGS. 1-9.
Figure 11:
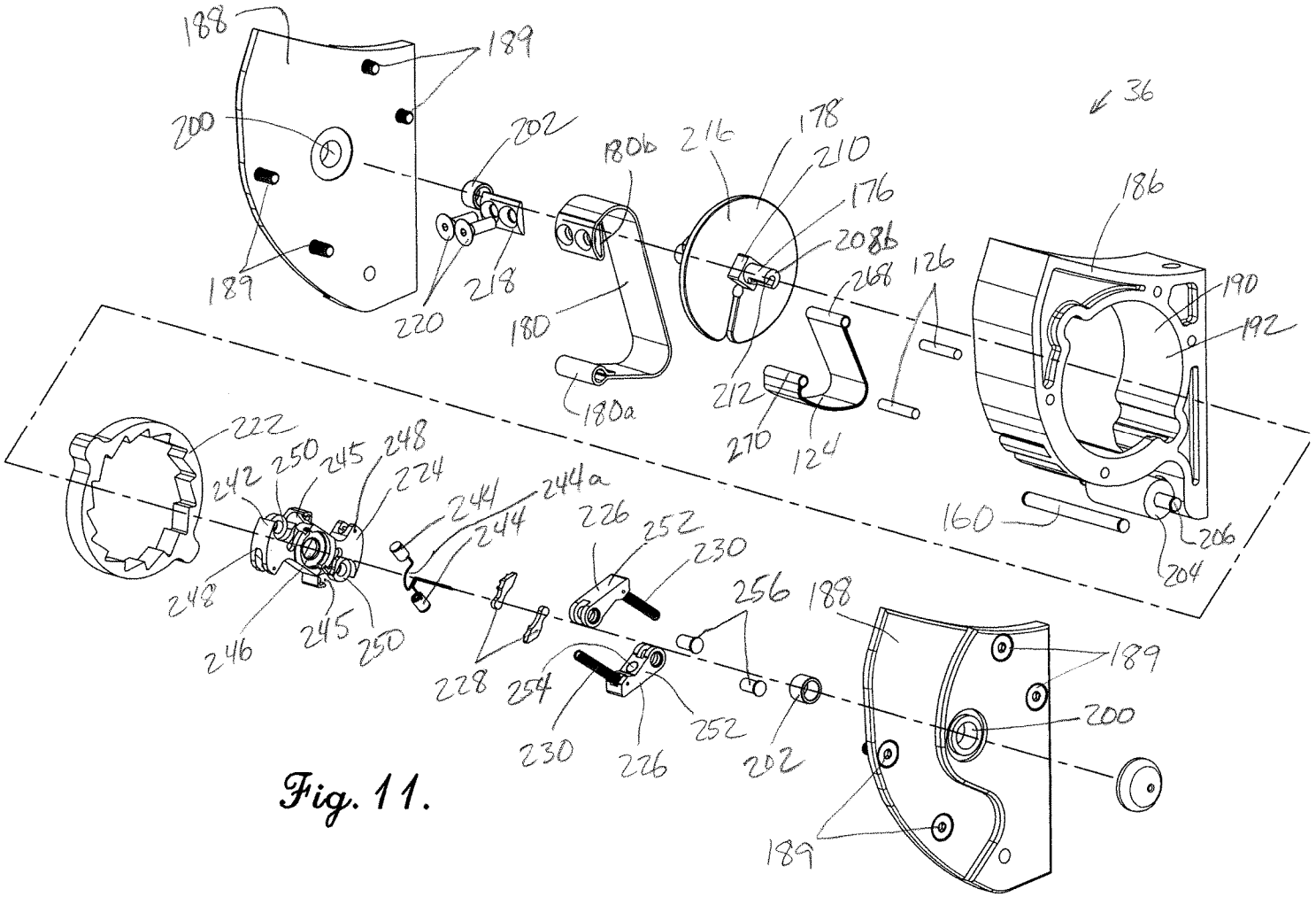
FIG. 11 is an exploded perspective of the centrifugal brake assembly and brake housing similar to FIG. 10, but taken from the opposite side of the centrifugal brake assembly and brake housing.

The illustrated housing 51 preferably includes an intermediate body 186 and opposite end covers 188 secured to the body 186 with fasteners 189 (see FIGS. 10 and 11). The body 186 presents an interior surface 190 that extends continuously through the body 186 to define a receiver 192. The body 186 also presents opposed margins 194 that define a slotted opening 196 (see FIGS. 6 and 8). As will be discussed, the slotted opening 196 permits the strap 180 and band 124 to extend into and out of the receiver 192. The body 186 also presents exterior slots 198 (see FIG. 8) located adjacent to the slotted opening 196.

The end covers 188 are each unitary and present a central axle opening 200. The end covers 188 support bushings 202 that are removably received by the axle openings 200 (see FIGS. 10 and 11).

The housing 51 further includes a strap roller 204 that is rotatably supported by an elongated roller pin 206.

The axle 176 is rotatably mounted in the housing 51 to support the brake member assembly 182 and the spool 178 for rotational movement. The axle 176 is unitary and includes opposite axle ends 208*a,b* (see FIGS. 6, 7, 10, and 11) and a splined portion 210 between the ends 208. The splined portion 210 (see FIG. 11) has a generally square cross-sectional shape and is configured to engage the brake member assembly 182. The axle end 208*b* presents a relief slot 212 (see FIGS. 7 and 11) operable to receive electrical wires, as will be discussed.

The spool 178 preferably includes a hub 214 and a disc-like flange 216 fixed to one another. The spool 178 also includes a keeper 218 removably attached to the hub 214 with threaded fasteners 220 (see FIGS. 6, 8, 10, and 11).

The spool 178 is mounted on and fixed to the axle 176 so that the spool 178 and axle 176 rotate as a single component within the housing 51. The spool 178 is located with the flange 216 adjacent to the splined portion 210. As will be discussed, the spool 178 is operable to rotate in a strap winding direction W and a strap unwinding direction U (see FIG. 8).

The connecting strap 180 serves to drivingly connect the lever 122 and the spool 178 to one another. The illustrated strap 180 comprises a unitary piece of flexible webbing material and presents a lever end 180*a* and a spool end 180*b*. The strap 180 is wrapped around the keeper 218 so that the spool end 180*b* is captured between the hub 214 and the keeper 218. The lever end 180*a* is attached to the lever 122 by the connection pin 160.

Figure 6:
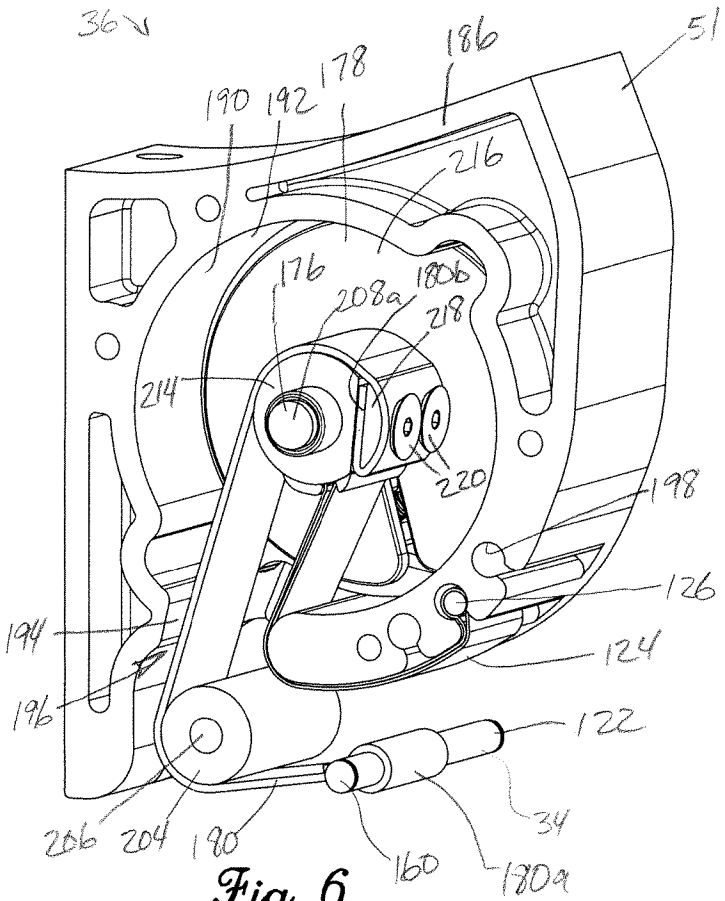
FIG. 6 is a fragmentary perspective of the motion restrictor shown in FIGS. 1-5, showing a spool, connecting strap, and axle of the centrifugal brake assembly mounted within a brake housing of the harness, with the centrifugal brake assembly being in a first position associated with the uppermost position of the levers.
Figure 8:
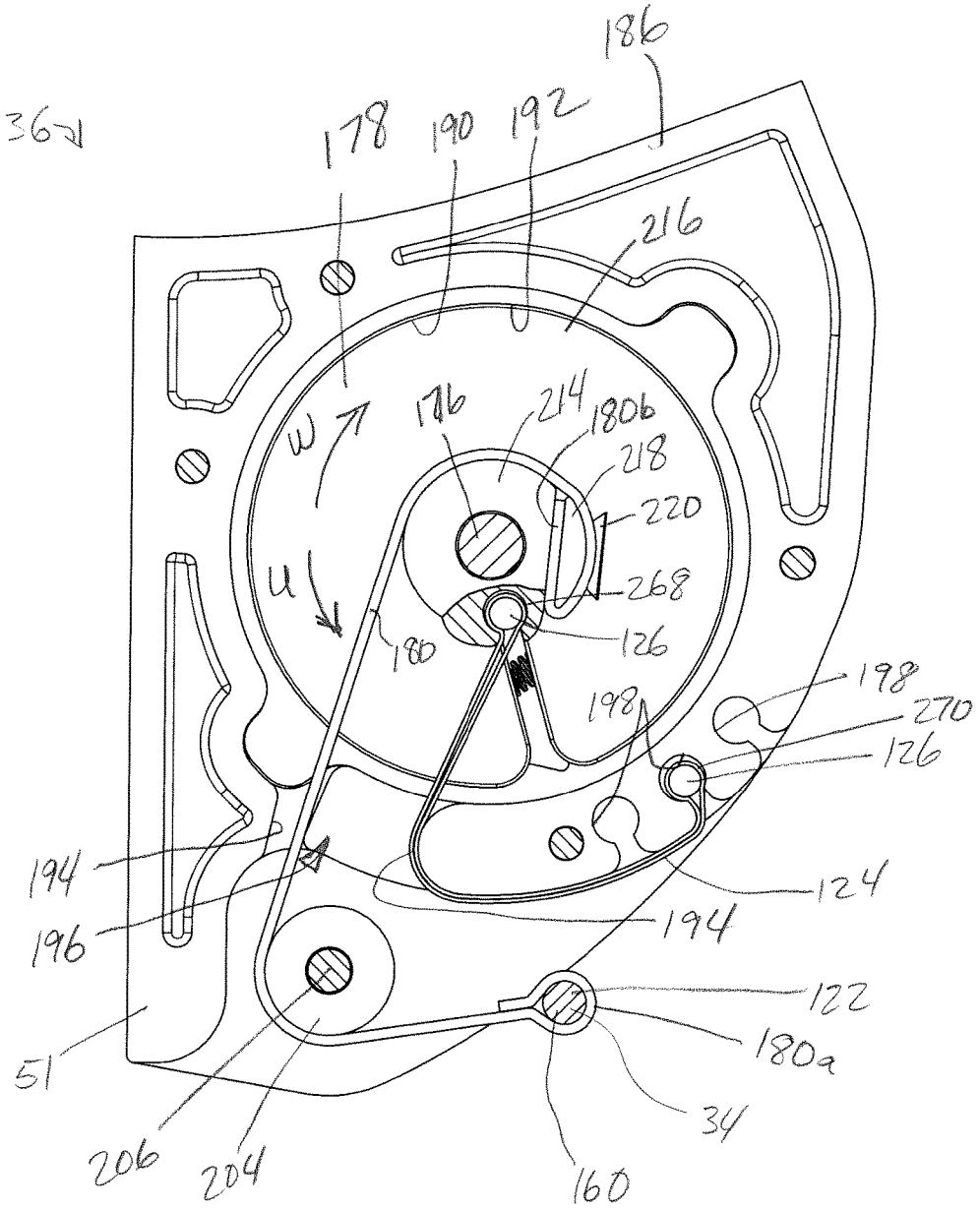
FIG. 8 is a side elevation of the centrifugal brake assembly and brake housing shown in FIGS. 1-7.
Figure 9:
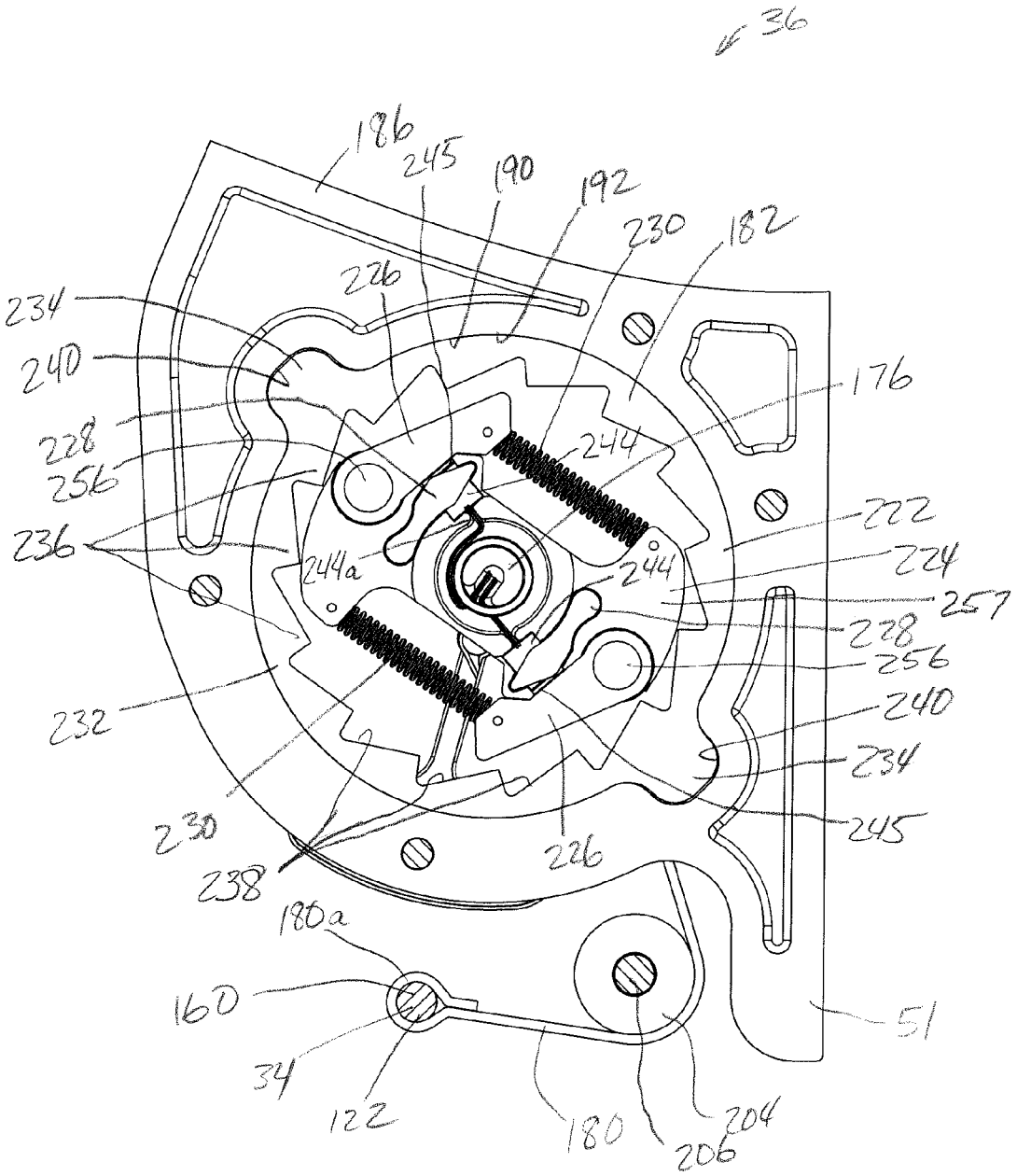
FIG. 9 is a side elevation of the centrifugal brake assembly and brake housing similar to FIG. 8, but taken from the opposite side of the centrifugal brake assembly to show the brake member assembly mounted within the housing.

When mounted to the spool 178 and the lever 122, the strap 180 passes through the slotted opening 196 and extends partly around the roller 204 (see FIGS. 6 and 8).

As the surface 120 moves downwardly from the uppermost position, the lever 122 pivots so as to pull the strap 180 rearwardly. This movement causes the strap 180 to move out of the receiver 192 and unwind from the spool 178. As a result, the spool 178 rotates in the unwinding direction U. The unwinding of the spool 178 produces a rotational spool velocity.

Similarly, as the spool 178 is spun in the winding direction W to wind the strap 180 onto the hub 214, the spool 178 generally draws the lever end 180*a* forwardly. This movement causes the lever 122 to pivot so that the surface 120 moves upwardly toward the uppermost position.

Although the spool 178 and lever 122 are preferably interconnected by the flexible webbing material, the brake assembly 36 could have an alternative flexible element. For instance, the brake assembly 36 could use a flexible wire, rope, cable, or chain in place of the connecting strap 180.

Each brake member assembly 182 preferably operates as a braking mechanism for the motion restrictor 30. As will be explained, according to one aspect of the invention, the brake member assembly 182 is configured to be engaged when a brake element thereof exceeds a predetermined threshold value of rotational velocity. Engagement of the brake member assembly 182 preferably serves to stop spool rotation. However, as will be discussed, the brake member assembly 182 could alternatively or additionally be configured to decelerate the rotational velocity of the spool 178. The brake member assembly 182 preferably includes a removable annular body 222, a rotatable frame 224, pawls 226, keepers 228, and springs 230 (see FIGS. 7 and 9-11).

The annular body 222 is configured to be engaged by the pawls 226 and preferably comprises a unitary structure. The annular body 222 preferably includes an endless ring portion 232 and oppositely spaced male protrusions 234 that extend outwardly from the ring portion 232 (see FIG. 9). The annular body 222 also preferably includes a plurality of stops 236 that are arranged in a circular pattern and circumferentially spaced apart from one another. The stops 236 extend radially inwardly from the ring portion 232, with each pair of adjacent stops 236 defining a notch 238 therebetween (see FIG. 9).

The notches 238 are configured to receive one of the pawls 226 when the brake member assembly 182 is engaged. As will be discussed, the pawls 226 can engage one or more of the stops 236 to provide braking of the brake member assembly 182. In the illustrated embodiment, the stops 236 are preferably engaged by the pawls 226 to stop rotation of the spool 178 without being fractured or severed by the pawls 226.

However, the annular body 222 could be alternatively configured to provide load absorption structure. For instance, an alternative annular body could include multiple alternative stops spaced along the ring portion and configured as breakaway elements. That is, the alternative stops could be configured to be fractured and severed by pawls to decelerate the spool by absorbing the load applied to the surfaces 120. Preferred features of several alternative annular bodies with breakaway elements are disclosed in detail in in U.S. Publication No. 2013/0205480, published Aug. 15, 2013, entitled ENERGY DISSIPATING BREAKAWAY ASSEMBLY FOR PROTECTIVE HELMET, which is hereby incorporated in its entirety by reference herein.

The annular body 222 preferably includes a metallic material that restricts the stops 236 from being fractured or severed by the pawl 226. However, the annular body 222 could include an alternative material (e.g., for providing suitable braking performance).

The annular body 222 is removably positioned in the receiver 192. The annular body 222 is inserted by aligning the protrusions 234 with corresponding female slots 240 in the housing 51. The annular body 222 can then be moved to a position adjacent the spool 178. Engagement between the protrusions 234 and the slots 240 restricts the annular body 222 from rotating within the housing 51.

The annular body 222 is preferably removable from the housing 51. However, the principles of the present invention are applicable where the annular body 222 is fixed to the housing 51 (e.g., where the stops 236 are integrally formed with the housing 51).

Additional features of alternative annular bodies, including removable and nonremovable bodies, are disclosed in the above-incorporated '480 publication.

The rotatable frame 224 is operable to be rotatably received by the housing 51 and is configured to spin relative to the annular body 222. The frame 224 preferably includes a frame body 242 that receives a pair of electromagnets 244 (see FIGS. 9-11). The electromagnets 244 are secured in chambers 245 presented by the frame body 242 with keepers 228 (see FIGS. 9-11). The electromagnets 244 each include a wire coil that surrounds a core and is integrally formed with wire leads 244*a*. As will be discussed, the electromagnets 244 comprise part of the electronic controller 38, which provides an alternative and/or additional means for actuating the brake assembly 36.

The frame body 242 is unitary and presents a central opening 246 to receive the axle 176. The central opening 246 includes a square socket that is sized and configured to receive the splined portion 210 of the axle 176. The frame body 242 also includes a pair of lugs 248, each of which presents a pawl seat 250 (see FIGS. 10 and 11).

Figure 14:
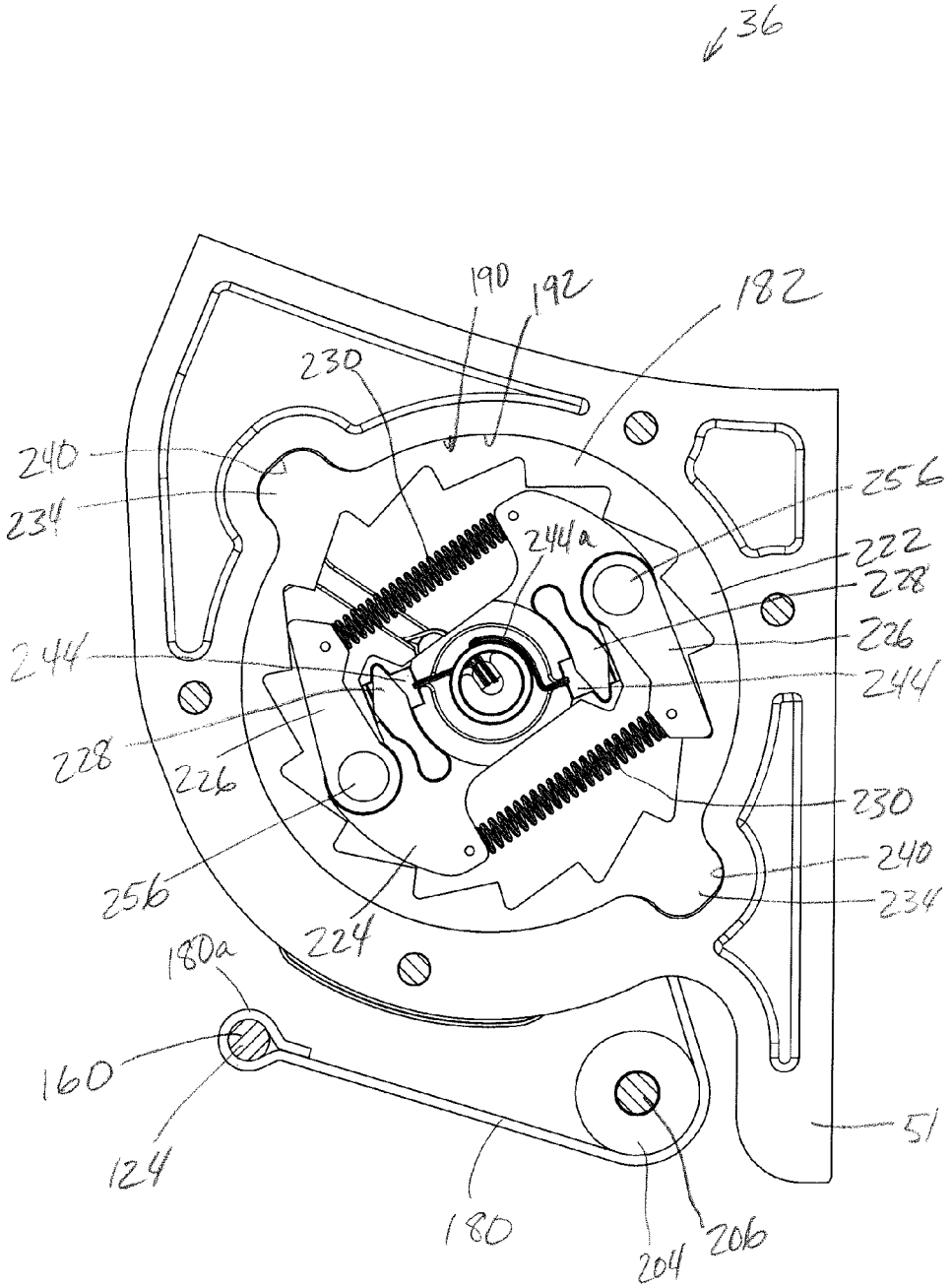
FIG. 14 is a side elevation of the centrifugal brake assembly and brake housing similar to FIG. 9, but showing the brake member assembly in the second position and the pawls shifted into a braking position where the pawls engage stops of the annular body.

The illustrated pawls 226 are generally identical to one another and each preferably includes an arm 252 and a permanent magnet 254 fixed within the arm 252 (see FIGS. 10 and 11). The pawls 226 are pivotally mounted to the pawl seats 250 with pivot pins 256 (see FIG. 9). The pawls 226 are operable to swing radially outwardly from a retracted position (see FIGS. 7 and 9) to a braking position (see FIG. 14) to engage one of the stops 236 when the brake assembly 36 is activated.

The rotatable frame 224 and pawls 226 cooperatively provide a shiftable brake element 257 (see FIGS. 7 and 9) that shifts into braking engagement with at least one of the stops 236 when the brake assembly 36 is engaged. Thus, as the brake assembly 36 is engaged, the brake element 257 moves rotationally (i.e., the frame 224 and pawls 226 rotate within the housing 51) and also preferably moves radially (i.e., the pawls 226 shift radially to engage the stops 236). As will be explained, the shiftable brake element 257 is coupled to the corresponding helmet-engagement surface 120 so that activation of the brake assembly 36 stops substantially all shifting of the helmet-engagement surface 120 along the range of motion.

The brake element 257 also preferably includes the illustrated springs 230. The springs 230 each preferably comprise a coil spring that interconnects the pawl 226 with the opposite lug 248. The springs 230 are preferably configured to rotate with the frame 224 and pawls 226 and to apply a spring force to the pawls 226 that urges the pawls 226 into the retracted position.

When the pawls 226 are located in the retracted position, each of the permanent magnets 254 is positioned adjacent to a corresponding one of the electromagnets 244. As will be discussed, the electromagnets 244 and permanent magnets 254 can be used to deploy the pawls 226 to the braking positions and thereby engage the brake member assembly 182.

While the illustrated configuration of pawls 226 and springs 230 is preferred for the brake element 257, the brake element 257 could include alternative pawls and/or springs. Additional features of alternative pawl and spring components are disclosed in the above-incorporated '480 publication.

As the brake element 257 and the spool 178 both spin within the housing 51, the pawls 226 generally move with the frame 224. When the brake element 257 and spool 178 rotate at a velocity below the threshold rotational velocity, the springs 230 retain the pawls 226 in the retracted position (see FIG. 9). When the brake element 257 and spool 178 rotate at a velocity above the threshold rotational velocity, the centrifugal force applied to the pawls 226 is greater than the spring force and, consequently, overcomes the spring force to shift the pawls 226 into the braking position (see FIG. 14).

The threshold rotational velocity value of the brake element 257 preferably corresponds with a condition of the user P, helmet H, and/or motion restrictor 30. For instance, the threshold rotational velocity value of the brake element 257 could correspond with a predetermined threshold velocity of the helmet engagement surface 120 and/or a predetermined threshold load applied to the helmet engagement surface 120. However, the threshold rotational velocity value could correspond to a predetermined value of another condition associated with the helmet engagement surface 120, another part of the lever 122, or another part of the motion restrictor 30. Furthermore, the threshold rotational velocity value could correspond to a predetermined value of a condition associated with the user P and/or the helmet H.

Again, the brake element 257 is configured to be engaged when the rotational velocity of the brake element 257 exceeds the threshold value of rotational velocity. When a condition of the user P, helmet H, and/or motion restrictor 30 is below the predetermined threshold value of the condition, the rotational velocity of the brake element 257 preferably operates below the threshold velocity value. For instance, when the actual velocity of the helmet engagement surface 120 is below the predetermined threshold velocity (e.g., during normal, non-injurious movement of the helmet H), the rotational velocity of the brake element 257 preferably operates below the threshold velocity value.

When a condition of the user P, helmet H, and/or motion restrictor 30 is above the predetermined threshold value of the condition, the rotational velocity of the brake element 257 preferably operates above the threshold velocity value. For instance, when the actual velocity of the helmet engagement surface 120 is above the predetermined threshold velocity (e.g., when the helmet H is impacted by a potentially injurious load), the rotational velocity of the brake element 257 preferably operates above the threshold velocity value.

The electromagnets 244 and permanent magnets 254 can also be used to shift the pawls 226 from the retracted position to the braking position. The electromagnets 244 are normally not energized so that the electromagnets 244 and permanent magnets 254 permit the pawls 226 to remain in the retracted position. When the electromagnets 244 are energized, the polarity of the electromagnets 244 opposes the polarity of the permanent magnets. The opposing polarity creates a magnetic force that magnetically induces the electromagnets 244 and the permanent magnets 254 away from one another. The electromagnets 244 and permanent magnets 254 are sized and configured so that the magnetic force is greater than the spring force and, consequently, overcomes the spring force to shift the pawls 226 into the braking position.

Importantly, the brake element 257 is preferably configured to be engaged solely due to centrifugal force associated with a rotational velocity that exceeds the threshold rotational velocity value. However, the brake member assembly 182 of the present invention could be engaged solely by the magnetic force produced by the electromagnets 244 and permanent magnets 254. Furthermore, the brake member assembly 182 could be engaged by a combination of the centrifugal force due to spool rotation and the magnetic force produced by the electromagnets 244 and permanent magnets 254.

Again, the notches 238 are configured to receive one of the pawls 226 when the brake member assembly 182 is engaged. As the frame 224 rotates with the pawls 226 in the braking position, one of the pawls 226 comes into braking engagement one of the stops 236 to provide a stopping mechanism (see FIG. 14). As the pawl 226 engages the stop 236 in the braking position, the pawl 226 stops rotation of the spool 178 without fracturing or severing the stop 236. Although only one of the pawls 226 engage a corresponding one of the stops 236 in the braking position, the brake assembly 36 could be alternatively configured. For instance, the stops 236 could be sized and configured so that both pawls 226 simultaneously engage corresponding stops 236 in the braking position.

The principles of the present invention are applicable where the brake member assembly 182 is alternatively configured to provide rotational braking of the spool 178 and corresponding deceleration of the surfaces 120. For instance, the size, shape, and/or configuration of the annular body 222, rotatable frame 224, stops 236, electromagnets 244, permanent magnets 254, and/or pawls 226 could be altered without departing from the scope of the present invention. Additional features of several suitable alternative brake member assemblies 182 are disclosed in the above-incorporated '480 publication.

Each brake assembly 36 preferably operates as a braking mechanism to restrict shifting of a corresponding one of the helmet-engagement surfaces 120 along the range of motion in response to injurious movement of the helmet H. With the lever 122 located in the uppermost position, the brake assembly 36 is located in a corresponding position (see FIGS. 6-9).

Initially, when the helmet H and motion restrictor 30 are donned by the user P and the user's neck is in a normally relaxed and upright position, each lever body 128 preferably engages the helmet H and is shifted downwardly by the helmet from the uppermost position (see FIGS. 3-5) to the normal upper position (see FIGS. 1 and 2). This movement of the lever 122 causes movement of the respective brake assembly 36 to a corresponding position (not shown). During normal, non-injurious head movement, the lever 122 moves as does the respective brake assembly 36.

Figure 12:
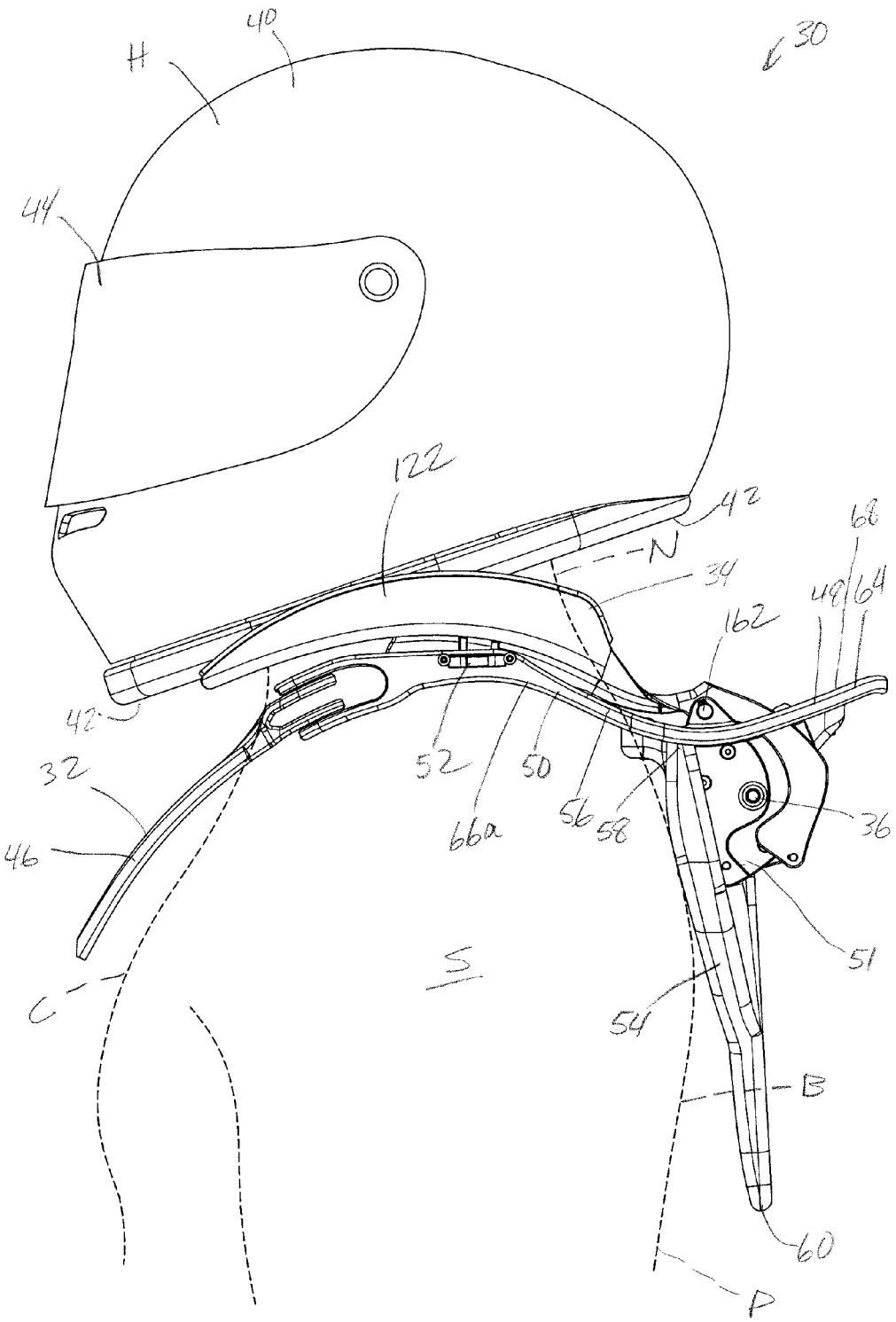
FIG. 12 is a side elevation of the helmet and motion restrictor similar to FIG. 2, but showing the helmet shifted downwardly so that the levers are shifted downwardly from the upper position to an intermediate position.
Figure 13:
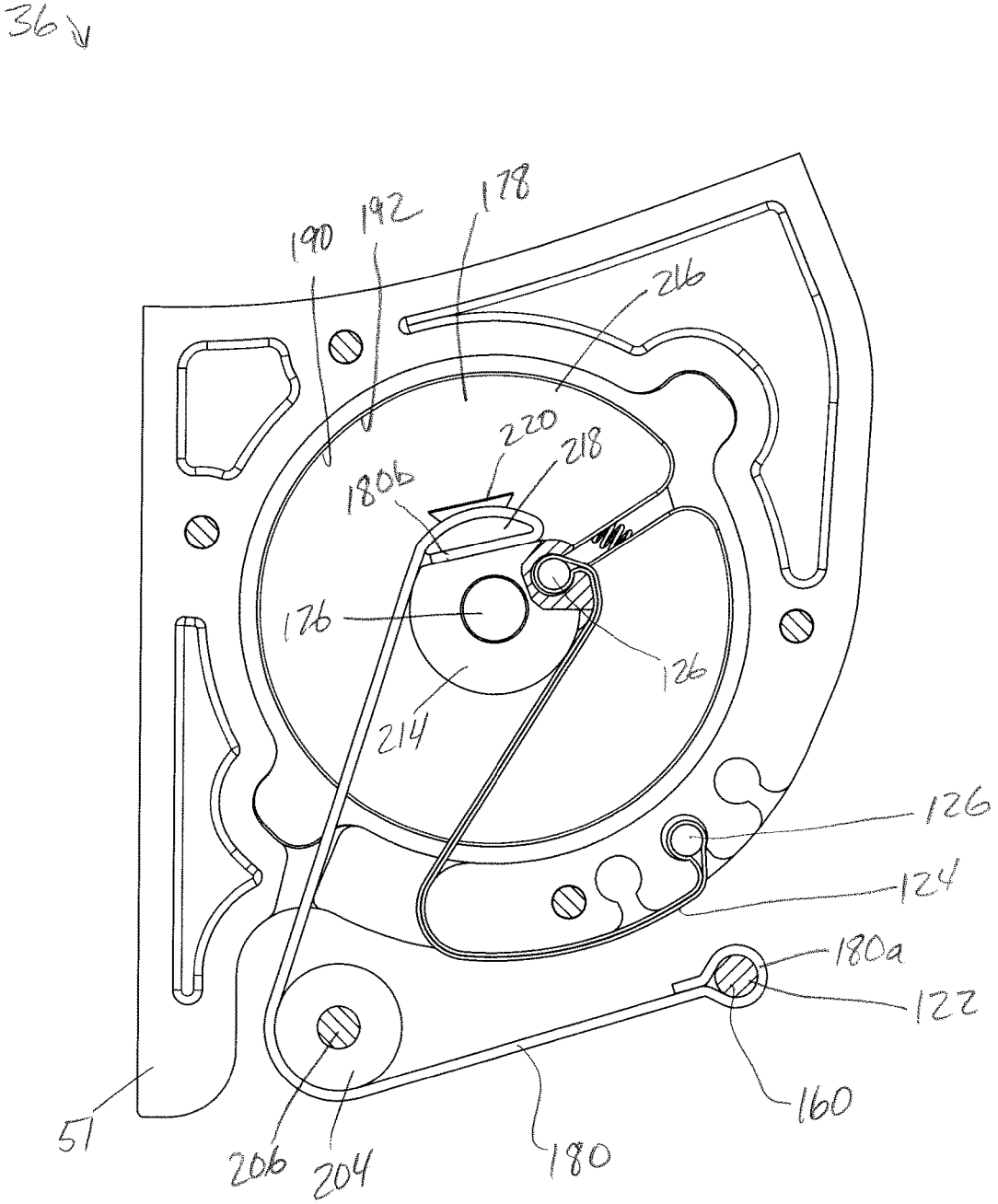
FIG. 13 is a side elevation of the centrifugal brake assembly and brake housing similar to FIG. 8, but showing the centrifugal brake assembly in a second position associated with the intermediate position of the levers, with the connecting strap being drawn out of the brake housing so that the spool is rotated in an unwinding direction to a second position.

The brake assembly 36 is configured to be engaged when the velocity of the brake element 257 exceeds the threshold rotational velocity value. For instance, as the lever 122 is forced downwardly in excess of the threshold velocity, the pawls 226 are caused to shift into the braking position (see FIGS. 12-14).

In the event that the threshold velocity is not exceeded by downward shifting of the lever 122, the lever 122 freely moves to the lowermost position without activating the respective brake assembly 36 (see FIGS. 15-20).

The brake member assembly 182, including the annular body 222, is preferably configured to stop substantially all rotational spool movement for injurious loads encountered by the helmet-engagement surfaces 120. However, an alternative brake member assembly could provide an alternative braking operation. For instance, when using an alternative annular body with breakaway elements, as described above, the alternative brake member assembly could be configured to stop substantially all rotational spool movement below a threshold load experienced by the helmet-engagement surface. As a result, the alternative brake member assembly stops downward movement of the lever body for loads applied to the lever body below the threshold load. Above the threshold load, the alternative brake member assembly with breakaway elements is configured to absorb loads to decelerate the spool rotational velocity. Consequently, the alternative brake member assembly decelerates downward movement of the lever body for loads applied to the lever body above the threshold load.

Returning to the illustrated embodiment, the brake assembly 36 is configured to be engaged when the lever body 128 moves downwardly to draw the strap 180 out of the housing 51, thereby unwinding the strap 180 from the spool 178 and causing the brake element to rotate at a velocity in excess of the threshold velocity value. It will be appreciated that the brake assembly 36 provides braking when at least one of the pawls 226 engages a corresponding stop 236, with the lever 122 generally positioned above the lowermost position.

The illustrated brake assemblies 36 are preferably operably disconnected from each other so that each brake assembly 36 can provide braking independently of the other brake assembly 36. Because the levers 122 are operably connected to corresponding brake assemblies 36 and shiftable relative to each other, the levers 122 are operable to pivot independently of one another and are configured to decelerate the helmet H independently of one another. However, for some aspects of the present invention, the brake assemblies 36 could be operably connected to cooperatively provide braking of the levers 122. Furthermore, the motion restrictor 30 could include a single brake assembly 36 to provide helmet deceleration.

When the brake assembly 36 is engaged to stop spool rotation, the lever 122 is preferably configured to flex slightly about the lateral axis of the pivot 162. When a load, particularly a relatively large load, is applied during brake engagement, the limited flexibility or "give" of the lever 122 enables the lever 122 to absorb at least some of the load applied to the helmet-engagement surface 120.

It is within the ambit of the present invention for the brake assembly 36 to be variously configured to decelerate movement of the levers 122. As previously noted, the size, shape, and/or configuration of the housing 51, axle 176, spool 178, brake member assembly 182, and/or strap 180 could be altered without departing from the scope of the present invention. Additional features of several suitable alternative rotatable brake member assemblies are disclosed in the above-incorporated '480 publication.

The brake element 257 of the brake assembly 36 is preferably rotatable and radially shiftable to provide suitable braking for the motion restrictor 30. However, the motion restrictor 30 could have a brake mechanism with alternative braking movement, such as a braking mechanism that moves linearly. Additional features of braking mechanisms with an alternative braking movement are disclosed in the above-incorporated '480 publication.

Figure 21:
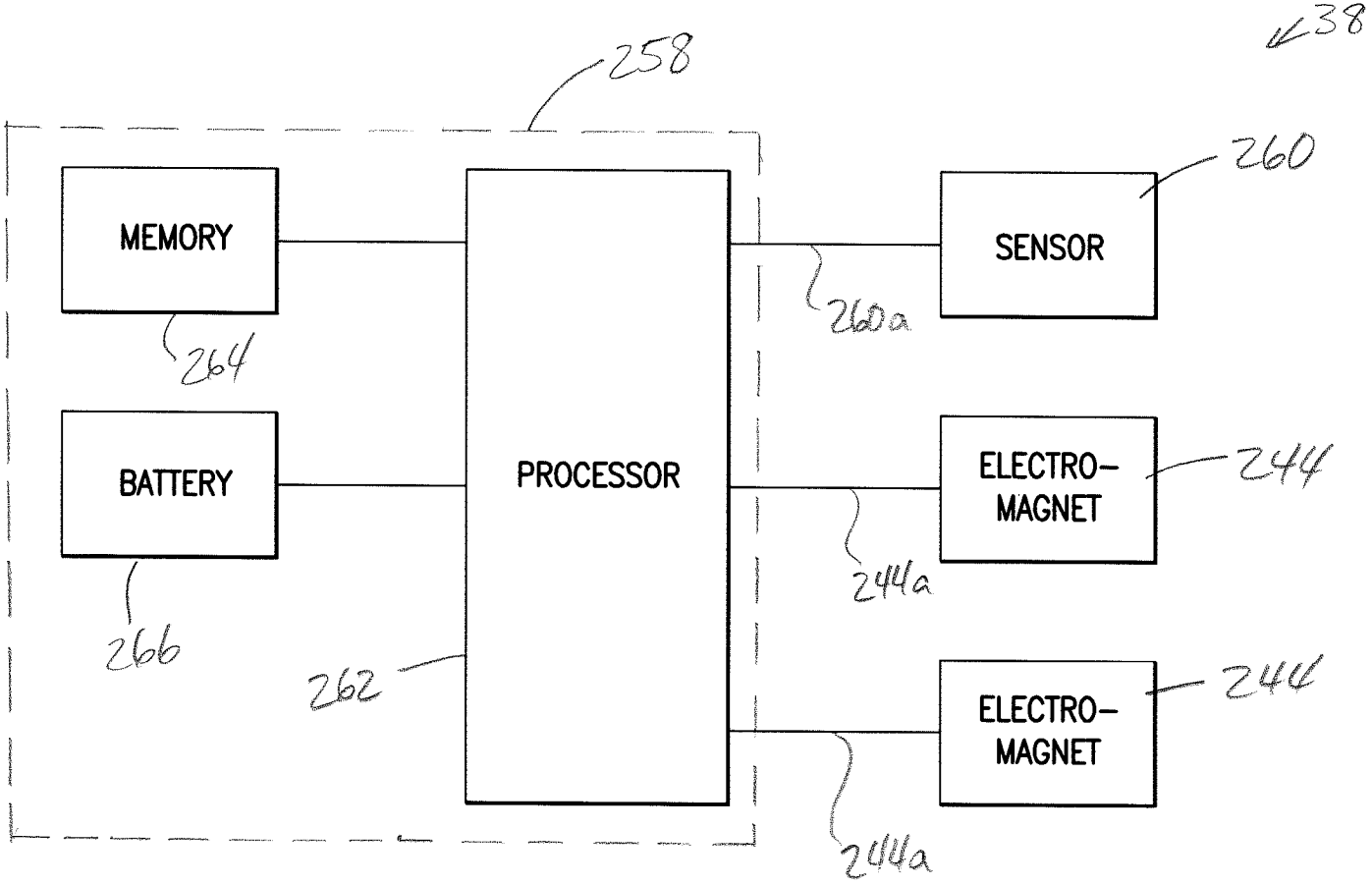
FIG. 21 is a fragmentary schematic view of the motion restrictor shown in FIGS. 1-20, showing a computing device operably coupled to a sensor and to electromagnets of the brake member assembly.

Turning to FIG. 21, the motion restrictor 30 also preferably includes the electronic controller 38 to selectively engage the brake member assembly 182. More particularly, the electronic controller 38 is configured to selectively magnetically induce shifting of the pawls 226 into the braking position. The electronic controller 38 preferably includes a computing device 258, a sensor 260 that communicates with the computing device 258 via a lead 260*a*, and the electromagnets 244.

The sensor 260 preferably comprises a transducer that directly or indirectly senses motion of the surfaces 120. The sensor 260 generates a corresponding electrical signal that is representative of an operational parameter and communicates the signal to the computing device 258. For instance, the transducer can be configured to sense the motion of the helmet-engagement surface 120 (or the lever 122 defining same), the spool 178, the brake element, or another moving component of the motion restrictor 30. Furthermore, the transducer can be configured to sense any load applied to the helmet-engagement surface 120, another portion of the lever 122, the spool 178, the brake element, or another component of the motion restrictor 30. Yet further, the transducer can be configured to sense other conditions of the helmet H and/or the user P.

Preferably, the sensor 260 comprises a transducer that senses velocity or acceleration of a component of the motion restrictor 30. For instance, the sensor 260 could include an accelerometer attached to the lever 122 at a location adjacent to one of the surfaces 120 to sense acceleration of the corresponding surface 120. It will be appreciated that various types of accelerometers, such as a piezoelectric accelerometer or a MEMS accelerometer, could be used to suitably sense movement of the surfaces 120. Also, the sensor 260 could include a rotational sensor (such as a Hall effect sensor) to sense the rotational speed and acceleration of the axle 176. Yet further, when the sensor 260 is configured to sense a load applied to a component of the motion restrictor 30, the sensor 260 could include any of various force-sensing transducers, such as a strain gauge.

The computing device 258 is operable to selectively activate the brake assembly 36. The computing device 258 preferably includes a processor element 262, a memory element 264, and a power source in the form of a battery 266.

The electromagnets 244 are configured to actuate the brake assembly 36. The leads 244*a* of the electromagnets 244 are electrically coupled to the processor element 262. The computing device 258 is configured so that the electromagnets 244 are normally not energized (i.e., a normally de-energized condition). Thus, the computing device 258 and electromagnets 244 cooperatively permit the pawls 226 to remain in the retracted position. When the electromagnets 244 are energized by the computing device 258, the polarity of the electromagnets 244 opposes the polarity of the permanent magnets, which creates a magnetic force that urges the electromagnets 244 away from the permanent magnets 254 (i.e., an energized condition). Again, the electromagnets 244 and permanent magnets 254 are sized and configured so that the magnetic force is greater than the spring force of the spring 230 and, consequently, overcomes the spring force to shift the pawls 226 into the braking position.

Based upon the parameter or condition sensed by the sensor 260, the computing device 258 preferably determines whether to engage the brake element 257. For instance, when the sensed condition of the user P, helmet H, and/or motion restrictor 30 is below the predetermined threshold value of the condition, the computing device 258 preferably keeps the electromagnets 244 in the de-energized condition so that the pawls 226 are retracted. The threshold value of the sensed condition may, but is not required to, correspond with the threshold velocity value of the brake element 257.

When the sensed parameter or condition of the user P, helmet H, and/or motion restrictor 30 is above the predetermined threshold value of the condition, the computing device 258 preferably operates the electromagnets 244 in the energized condition to shift the pawls 226 into the braking position (to engage the brake assembly 36).

The electronic controller 38 preferably includes the electromagnets 244 to provide actuation of the brake element 257 and shift the pawls 226 into and out of the braking position. However, the electronic controller 38 could include an alternative actuator to shift the brake element 257, such as an electric motor.

The processor element 262 may include microprocessors, microcontrollers, digital signal processors (DSPs), field-programmable gate arrays (FPGAs), analog and/or digital application-specific integrated circuits (ASICs), and the like, or combinations thereof. The processor element 262 may generally execute, process, or run instructions, code, software, firmware, programs, applications, apps, or the like, or may step through states of a finite-state machine.

The memory element 264 may include data storage components such as read-only memory (ROM), random-access memory (RAM), hard-disk drives, optical disk drives, flash memory drives, and the like, or combinations thereof. The memory element 264 may include, or may constitute, a "computer-readable medium". The memory element 264 may store the instructions, code, software, firmware, programs, applications, apps, or the like that are executed by the processor element 262. The memory element 264 may also store settings or data.

The computing device 258 may specifically include mobile communication devices (including wireless devices), work stations, desktop computers, laptop computers, palmtop computers, tablet computers, portable digital assistants (PDA), smart phones, and the like, or combinations thereof. Various embodiments of the computing device 258 may also include voice communication devices, such as cell phones or landline phones. In preferred embodiments, the computing device 258 will have an electronic display, such as a liquid crystal display, plasma, or touch screen that is operable to display visual graphics, images, text, etc. In certain embodiments, the computer program of the present invention facilitates interaction and communication through a graphical user interface (GUI) that is displayed via the electronic display. The GUI enables the user to interact with the electronic display by touching or pointing at display areas to provide information to the user control interface, which is discussed in more detail below. In additional preferred embodiments, the computing device 258 may include an optical device such as a digital camera, video camera, optical canner, or the like, such that the computing device 258 can capture, store, and transmit digital images and/or videos.

The computing device 258 may include a user control interface that enables one or more users to share information and commands with the computing device 258. The user interface may facilitate interaction through the GUI described above or may additionally comprise one or more functionable inputs such as buttons, keyboard, switches, scrolls wheels, voice recognition elements such as a microphone, pointing devices such as mice, touchpads, tracking balls, styluses. The user control interface may also include a speaker for providing audible instructions and feedback. Further, the user control interface may comprise wired or wireless data transfer elements, such as a communication component, removable memory, data transceivers, and/or transmitters, to enable the user and/or other computing devices to remotely interface with the computing device.

Although not illustrated as such, the computing device 258 is preferably mounted on the harness 32 in a location where the computing device 258 is protected from contact with external objects. For instance, the computing device 258 could be removably mounted in a housing (not shown) on the back panel 54 between the centrifugal brake assemblies 36.

It will be appreciated that the controller 38 could be variously configured to provide selective actuation of the brake assembly 36. However, for at least some aspects of the present invention, the motion restrictor 30 could be devoid of an electronic controller.

Turning again to FIGS. 6-11, the helmet-engaging component 34 preferably includes resilient bands 124. The resilient band 124 provides a preferred biasing member configured to yieldably bias the helmet-engagement surfaces 120 upwardly toward the uppermost position. The band 124 comprises a unitary and endless strip of material. The band 124 preferably includes an elastic material, such as an elastomeric resin.

The illustrated band 124 removably interconnects the spool 178 and the lever 122. More particularly, the band 124 is elongated to form opposite ends 268,270, with the end 268 being removably attached to the hub 214 by one of the pins 126 (see FIG. 8). The other end 270 of the band 124 is removably attached to the housing 51 by inserting another one of the pins 126 and the end 270 into one of the exterior slots 198. The slotted opening 196 permits the band 124 to extend into and out of the receiver 192.

The end 270 can be selectively secured in any one of the exterior slots 198. It will be understood that insertion of the end 270 into the slot 198 closest to the slotted opening 196 will result in relatively minimal stretching of the band 124. On the other hand, insertion of the end 270 into the slot 198 farthest from the slotted opening 196 will result in a relatively larger amount of stretching of the band 124. This arrangement provides adjustability in the spring force exerted on the lever 122 by the band 124.

With the lever 122 in the uppermost position, the band 124 is preferably resiliently stretched and urges the spool 178 to rotate in the winding direction W. In turn, the tension force applied by the band 124 to the spool 178 serves to tension the strap 180 so that the lever 122 and the corresponding helmet-engagement surface 120 are yieldably biased toward the uppermost position.

As the lever 122 is shifted downwardly away from the uppermost position, the spool 178 is rotated in the unwinding direction U, which preferably increases the amount of stretch experienced by the resilient band 124 and increases the tension in the band 124. As a result, the tension in the strap 180 generally increases as the lever 122 moves toward the lowermost position. While this increasing tension in the band 124 and the strap 180 is preferred to urge the lever 122 to return to the uppermost position, the tension in these components could be varied while still yieldably biasing the helmet-engagement surfaces 120 toward the uppermost position.

Furthermore, various alternative mechanisms could be provided to yieldably bias the surfaces 120 into the uppermost position without departing from the scope of the present invention. For instance, the motion restrictor 30 could include a linear spring (not shown) that interconnects the stop-arm 130 and the harness 32 to urge the surfaces 120 upwardly.

The illustrated bands 124 are preferably operably disconnected from each other so that each band 124 can operate independently of the other band 124. Because the levers 122 are operably connected to corresponding brake assemblies 36 and shiftable relative to each other, the levers 122 are operable to pivot independently of one another and are configured to be biased independently of one another by the corresponding band 124 toward the uppermost position. However, for some aspects of the present invention, the bands 124 could be operably connected to cooperatively provide yieldable upward biasing of the levers 122. Furthermore, the motion restrictor 30 could include a single band or alternative biasing member to provide yieldable upward biasing of the levers 122.

In the illustrated embodiment, the bands 124 urge the levers 122 in a direction opposite the downward direction of injurious movement, although the resistance provided by the bands 124 is generally negligible. That is, the resistance to downward injurious movement provided by the bands 124 is unlikely to have a significant impact on the injurious movement.

In use, the motion restrictor 30 can be donned by the user P to decelerate and stop the helmet H in response to excessive acceleration and/or external force, particularly when the acceleration or force could lead to injury of the user. The user can don the helmet H prior to donning the motion restrictor 30. However, the user could alternatively don the helmet H after donning the motion restrictor 30.

Prior to donning the motion restrictor 30, the levers 122 are preferably moved to the stored position (see FIGS. 18-20) to restrict the levers 122 from interfering with the donning process. Once the motion restrictor 30 and helmet H are both donned, the levers 122 can then be released from the stored position. However, the motion restrictor 30 could be donned with the levers 122 out of the stored position (e.g., with the levers 122 in the uppermost position). If the user dons the helmet H prior to donning the motion restrictor 30, the helmet H could interfere with donning of the motion restrictor 30, particularly if the levers 122 are not secured in the stored position.

The motion restrictor 30 can be donned by first entirely detaching the sections 46,48 from one another. The detached sections 46,48 can then be positioned on opposite sides of the neck N and then attached to one another.

Alternatively, the motion restrictor 30 can be donned by first having one of the male connectors 102 attached to a corresponding one of the female connectors 70. The sections 46,48 can then be swung so that the neck N of user P can move through the open passage defined between the sections 46,48. With the neck N received in the neck opening 114, the other pair of male and female connectors 102,70 can be swung toward each other to close the open passage. The male and female connectors 102,70 can then be engaged to secure the harness 32 around the user's neck N.

With the motion restrictor 30 and helmet H donned, the motion restrictor 30 permits the user to comfortably and easily slide the helmet fore-and-aft, slide the helmet laterally to a limited extent, rotate the helmet from side-to-side, and tilt the helmet in a fore-and-aft direction and/or in a lateral direction. In this manner, the user's head and the helmet are permitted to freely move relative to the user's torso as if the user was not wearing the motion restrictor 30.

The motion restrictor 30 can be selectively removed by the user by detaching either one or both pairs of male and female connectors 102,70 from each other so that the sections 46,48 can be moved apart from each other. The user can move the levers 122 to the stored position prior to removing the motion restrictor 30, although such a step is optional.

Turning to FIGS. 22 and 23, an alternative motion restrictor 300 is depicted. For the sake of brevity, the remaining description will focus primarily on the differences of this embodiment from the first preferred embodiment described above. The alternative motion restrictor 300 generally includes a harness 302, an alternative helmet-engaging component 304, and centrifugal brake assemblies 306.

Each brake assembly 306 is mounted in a housing 308 of the harness 302. The brake assembly 306 includes, among other things, a spool 310, and an alternative connecting strap 312.

The alternative helmet-engaging component 304 preferably includes a pair of elongated leaf spring elements 314. The helmet-engaging component 304 also preferably includes resilient bands (not shown) similar to band 124 to urge the respective spool 310 to rotate in a winding direction to wind up the corresponding strap 312.

The leaf spring elements 314 each present a helmet-engagement surface 316. Each leaf spring element 314 flexes as the corresponding one of the helmet-engagement surfaces 316 shifts along the range of motion.

The leaf spring element 314 presents opposite front and rear ends 318,320. The rear end 320 is preferably fixed relative to the harness 302, while the front end 318 is preferably shiftable along the harness 302. More particularly, the front end 318 is preferably shiftable forwardly and downwardly along the harness 302 to accommodate downward flexing of the leaf spring element 314. In a similar manner, the front end 318 is preferably shiftable rearwardly and upwardly along the harness 302 to accommodate upward flexing of the leaf spring element 314.

The leaf spring element 314 is preferably configured to flex between an uppermost unflexed position (not shown) and a plurality of flexed positions. In the unflexed position, the helmet-engagement surface 316 presents a generally convex shape.

For instance, when the helmet H and motion restrictor 300 are donned by the user and the user's neck is in a normally relaxed and upright position, the leaf spring elements 314 preferably engage the helmet H and are flexed downwardly into a normal flexed position (see FIG. 22). In the normal flexed position, the front end 318 moves forwardly and downwardly from the unflexed position. Furthermore, the convex shape of at least part of the helmet-engagement surface 316 is generally flattened when compared to the unflexed position.

When the helmet H and motion restrictor 300 are donned by the user and the user's neck and head are moved relative to the harness 302, the leaf spring elements 314 preferably engage the helmet H and are flexed downwardly to a greater degree into a lower flexed position. In the lower flexed position, the front end 318 moves forwardly and downwardly from the normal flexed position. Furthermore, the convex shape of at least part of the helmet-engagement surface 316 is generally flattened when compared to the normal flexed position. The brake assembly 306 operates to halt flexing of the leaf spring element 314 in response to injurious movement of the helmet H.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion, and a brake assembly operable to restrict shifting of at least one of the helmet-engagement surfaces in response to injurious movement of the helmet, each of said helmet-engagement surfaces being shiftable against the yieldable bias into a stored position, said harness including a releasable latch operable to removably secure each helmet-engagement surface in the stored position.

2. The motion restrictor device as claimed in claim 1, said harness including a pair of fore-and-aft shoulder plates for placement on top of the shoulders of the user, said releasable latch including a pair of spring-engaged latch members, each of which releasably intercouples with the helmet-engaging component when a corresponding one of the helmet-engagement surfaces is in the stored position.

3. The motion restrictor device as claimed in claim 1, each of said helmet-engagement surfaces shifting up and down along the range of motion, said stored position being adjacent a lowermost limit of the range of motion.

4. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion, and a brake assembly operable to restrict shifting of at least one of the helmet-engagement surfaces in response to injurious movement of the helmet, said helmet-engaging component including a pair of swingable levers, each of which defines a corresponding one of the helmet-engagement surfaces.

5. The motion restrictor device as claimed in claim 4, said harness including a back panel dimensioned and configured to be placed against the back of the user.

6. The motion restrictor device as claimed in claim 5, said harness including a pair of shoulder plates, each of which projects forwardly from the back panel for placement on top of a corresponding one of the shoulders of the user.

7. The motion restrictor device as claimed in claim 6, said harness including a breastplate dimensioned and configured to be placed against the chest of the user, said back panel, shoulder plates, and breastplate cooperatively presenting a central opening which receives the neck of the user when the harness is worn.

8. The motion restrictor device as claimed in claim 7, said back panel, shoulder plates, and breastplate defining an at least substantially continuous collar that comprises carbon fiber.

9. The motion restrictor device as claimed in claim 8, said back panel and shoulder plates being integrally formed and thereby at least substantially fixed relative to one another, said breastplate being joined to the shoulder plates to permit limited relative movement therebetween.

10. The motion restrictor device as claimed in claim 4, said harness presenting a rear top surface configured to engage the helmet and thereby limit extension of the neck.

11. The motion restrictor device as claimed in claim 4, said helmet-engagement surfaces being configured to slidably contact the helmet, with the helmet-engaging component being otherwise disconnected from the helmet.

12. The motion restrictor device as claimed in claim 4, said helmet-engaging component including a pair of pivots coupled to the harness, with each lever presenting a main body portion extending from a respective one of the pivots to define the corresponding one of the helmet-engagement surfaces.

13. The motion restrictor device as claimed in claim 12, each of said levers including a stop-arm in portion extending from the respective one of the pivots in a direction opposite the main body portion, each of said stop-arm portions being configured to contact the harness and thereby limit swinging of the lever.

14. The motion restrictor device as claimed in claim 13, said main body portion adapted to swing generally up and down to define the range of motion of the corresponding one of the helmet-engagement surfaces, with contact between the stop-arm portion and the harness serving to limit upward swinging of the main body portion.

15. The motion restrictor device as claimed in claim 12, said levers being independently swingable relative to one another.

16. The motion restrictor device as claimed in claim 4, each of said levers swinging up and down to define the range of motion of the corresponding one of the helmet-engagement surfaces, said helmet-engaging component including a biasing member coupled to the lever to yieldably bias the helmet-engagement surfaces upwardly.

17. The motion restrictor device as claimed in claim 16, said biasing member including a pair of resilient bands, each of which is coupled between the harness and a corresponding one of the levers to resiliently stretch as the helmet-engagement surface shifts downwardly along the range of motion.

18. The motion restrictor device as claimed in claim 4, each of said helmet-engagement surfaces presenting a curvilinear upwardly convex shape.

19. The motion restrictor device as claimed in claim 18, said helmet-engagement surfaces being configured to slidably contact the helmet, each of said helmet-engagement surfaces including a low friction coating to facilitate sliding thereof relative to the helmet.

20. The motion restrictor device as claimed in claim 4, each of said helmet-engagement surfaces being defined by fore-and-aft walls, said walls including an upstanding wall and a lateral wall that projects inwardly from the upstanding wall.

21. The motion restrictor device as claimed in claim 4, further comprising:

a second brake assembly, with each of the brake assemblies being operable to restrict shifting of a respective one of the helmet-engagement surfaces.

22. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion; and a brake assembly operable to restrict shifting of at least one of the helmet-engagement surfaces in response to injurious movement of the helmet, said helmet-engaging component including a pair of leaf spring elements, each of which defines a corresponding one of the helmet-engagement surfaces, each of said leaf spring elements flexing as the corresponding one of the helmet-engagement surfaces shifts along the range of motion.

23. The motion restrictor device as claimed in claim 22, each of said leaf spring elements presenting opposite front and rear ends, one of which is fixed relative to the harness and the other of which shifts in a fore-and-aft direction relative to the harness.

24. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion; and a brake assembly operable to restrict shifting of at least one of the helmet-engagement surfaces in response to injurious movement of the helmet, each of said helmet-engagement surfaces being defined by fore-and-aft walls, said walls including an upstanding wall and a lateral wall that projects inwardly from the upstanding wall, at least a forwardmost portion of said upstanding wall presenting a height that tapers forwardly.

25. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion; and a brake assembly operable to restrict shifting of at least one of the helmet-engagement surfaces in response to injurious movement of the helmet, each of said helmet-engagement surfaces being defined by fore-and-aft walls, said walls including an upstanding wall and a lateral wall that projects inwardly from the upstanding wall, said lateral wall presenting a laterally innermost edge, said fore-and-aft walls including a neck-engaging wall depending from the laterally innermost edge.

26. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion; and a brake assembly operable to restrict shifting of at least one of the helmet-engagement surfaces in response to injurious movement of the helmet, said brake assembly including a series of spaced apart stops, said brake assembly including a shiftable brake element that shifts into braking engagement with at least one of the stops when the brake assembly is activated, said shiftable brake element being coupled to said at least one of the helmet-engagement surfaces so that activation of the brake assembly stops substantially all shifting of said at least one of the helmet-engagement surfaces along the range of motion.

27. The motion restrictor device as claimed in claim 26, said stops being arranged in a circular pattern so as to be circumferentially spaced apart, said brake element shifting radially into engagement with at least one of the stops when the brake assembly is activated.

28. The motion restrictor device as claimed in claim 27, said brake element being rotatable so as to rotate in response to shifting of said at least one of the helmet-engagement surfaces, said brake element being shifted by centrifugal force into engagement with at least one of the stops when the brake assembly is activated.

29. The motion restrictor device as claimed in claim 28, further comprising:

a controller operable to selectively activate the brake assembly, said controller including an actuator selectively powered to shift the brake element into engagement with at least one of the stops when the brake assembly is activated.

30. The motion restrictor device as claimed in claim 29, said actuator including a electromagnet that is energized when the actuator is powered, with shifting of the brake element being magnetically induced.

31. The motion restrictor device as claimed in claim 29, said controller including a sensor operable to generate a signal representative of an operational parameter, said controller including a processor operably coupled with the sensor and configured to determine when the signal exceeds a threshold value, said processor being operably coupled to the actuator so that the brake element is shifted by the actuator when the signal exceeds the threshold value.

32. The motion restrictor device as claimed in claim 28, said brake element being located radially inside the stops.

33. The motion restrictor device as claimed in claim 26, said brake element being rotatable so as to rotate in response to shifting of said at least one of the helmet-engagement surfaces, said brake assembly including a rotatable spool, with rotation of the spool corresponding with rotational movement of the brake element, said brake assembly including an elongated flexible connector presenting opposite first and second ends, said connector being fixed adjacent the first end to the spool and fixed relative to said at least one of the helmet-engagement surfaces adjacent the second end, with spool rotation thereby corresponding with shifting of said at least one of the helmet-engagement surfaces along the range of motion.

34. The motion restrictor device as claimed in claim 33, each of said helmet-engagement surfaces shifting generally upwardly and downwardly along the range of motion, said spool rotating in a first direction as said at least one of the helmet-engagement surfaces shifts upwardly along the range of motion, said helmet-engaging component including a biasing member coupled to the spool to yieldably bias the spool in the first direction.

35. The motion restrictor device as claimed in claim 34, said biasing member including a resilient band connected between the harness and the spool to resiliently stretch as said at least one of the helmet-engagement surfaces shifts downwardly along the range of motion.

36. A motion restrictor device to be worn with a protective helmet so as to reduce the risk of head or spine injury caused by injurious movement of the helmet, said motion restrictor device comprising:

a harness wearable by a user of the helmet;

a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion;

a brake assembly operable to restrict shifting of at least one of the helmet-engagement surfaces in response to injurious movement of the helmet; and a second brake assembly, with each of the brake assemblies being operable to restrict shifting of a respective one of the helmet-engagement surfaces, each of said brake assemblies including a series of spaced apart stops and a shiftable brake element, said brake element shifting into braking engagement with at least one of the stops when the brake assembly is activated, said brake element being coupled to the respective one of the helmet-engagement surfaces so that activation of the brake assembly stops substantially all shifting of the respective one of the helmet-engagement surfaces along the range of motion.

37. The motion restrictor device as claimed in claim 36, said brake element being rotatable so as to rotate in response to shifting of said at least one of the helmet-engagement surfaces, each of said brake assemblies including a rotatable spool, with rotation of the spool corresponding with rotational movement of the brake element, each of said brake assemblies including an elongated flexible connector presenting opposite first and second ends, said connector being fixed adjacent the first end to the spool and fixed relative to the respective one of the helmet-engagement surfaces adjacent the second end, with spool rotation thereby corresponding with shifting of the respective one of the helmet-engagement surfaces along the range of motion.

38. The motion restrictor device as claimed in claim 37, each of said helmet-engagement surfaces shifting upwardly and downwardly along the range of motion, said spool rotating in a first direction as the respective one of the helmet-engagement surfaces shifts upwardly along the range of motion, said helmet-engaging component including a biasing member coupled to the spool to yieldably bias the spool in the first direction.

39. The motion restrictor device as claimed in claim 38, said helmet-engaging component including a pair of swingable levers, each of which defines a corresponding one of the helmet-engagement surfaces, said helmet-engaging component including a pair of pivots coupled to the harness, each of said levers presenting portions extending in opposite directions relative to a respective one of the pivots, with one portion of each lever defining the corresponding one of the helmet-engagement surfaces, said second end of each connector being fixed to the other portion of a corresponding lever.

40. The motion restrictor device as claimed in claim 39, said levers being independently swingable relative to one another.

41. A motion restrictor device to be worn with a protective helmet so as to reduce the risk of head or spine injury caused by injurious movement of the helmet, said motion restrictor device comprising:

a harness wearable by a user of the helmet, a helmet-engaging component supported on the harness, said helmet-engaging component presenting laterally spaced apart, fore-and-aft extending helmet-engagement surfaces positioned on opposite sides of the neck of the user when the device is worn, each of said helmet-engagement surfaces being configured to shift along a range of motion while in contact with the helmet as the helmet moves, said helmet-engaging component being operable to yieldably bias each of the helmet-engagement surfaces toward the helmet when the device is worn, such that contact with the helmet is maintained as the helmet-engagement surface shifts through the range of motion;

a brake assembly operable to restrict shifting of at least one of the helmet-engagement surfaces in response to injurious movement of the helmet, said brake assembly configured to be activated to stop substantially all shifting of at least one of the helmet-engagement surfaces along the range of motion; and a controller operable to selectively activate the brake assembly.

42. The motion restrictor device as claimed in claim 41, said controller including a sensor operable to generate a signal representative of an operational parameter, with the signal exceeding a threshold value when the operational parameter corresponds to injurious movement of the helmet, said controller including a processor operably coupled with the sensor and configured to determine when the signal exceeds the threshold value.

43. The motion restrictor device as claimed in claim 42, said brake assembly including a shiftable brake element that shifts into a braking position when the brake assembly is activated, said brake element being coupled to at least one of the helmet-engagement surfaces so that activation of the brake assembly shifts the brake element into the braking position and thereby stops substantially all shifting of said at least one of the helmet-engagement surfaces along the range of motion, said controller including an actuator operably coupled to the processor and selectively powered to shift the brake element into the braking position when the processor determines the signal exceeds the threshold value.

44. The motion restrictor device as claimed in claim 43, said actuator including a electromagnet that is energized when the actuator is powered, with shifting of the brake element being magnetically induced.

45. The motion restrictor device as claimed in claim 41, said brake assembly including a shiftable brake element that shifts into a braking position when the brake assembly is activated, said brake element being coupled to at least one of the helmet-engagement surfaces so that activation of the brake assembly shifts the brake element into the braking position and thereby stops substantially all shifting of said at least one of the helmet-engagement surfaces along the range of motion, said controller including an actuator selectively powered to shift the brake element into the braking position in response to injurious movement of the helmet, said actuator including a electromagnet that is energized when the actuator is powered, with shifting of the brake element being magnetically induced.

* * * * *